US007547498B2

(12) United States Patent
Yamane et al.

(10) Patent No.: US 7,547,498 B2
(45) Date of Patent: Jun. 16, 2009

(54) TONER FOR DEVELOPING ELECTROSTATIC LATENT IMAGES AND A PRODUCTION METHOD FOR THE SAME

(75) Inventors: Kenji Yamane, Sagamihara (JP); Masafumi Uchida, Toyokawa (JP); Yasuko Yamauchi, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 215 days.

(21) Appl. No.: 10/964,117

(22) Filed: Oct. 13, 2004

(65) Prior Publication Data

US 2005/0147908 A1 Jul. 7, 2005

(30) Foreign Application Priority Data

Oct. 16, 2003 (JP) ..... 2003-356065
Oct. 22, 2003 (JP) ..... 2003-361583

(51) Int. Cl.
*G03G 9/08* (2006.01)

(52) U.S. Cl. ..... 430/108.6; 430/108.7; 430/108.2; 430/110.3; 430/110.4

(58) Field of Classification Search ..... 430/108.6, 430/108.7, 108.2, 110.3, 110.4
See application file for complete search history.

(56) References Cited

U.S. PATENT DOCUMENTS

| | | | | |
|---|---|---|---|---|
| 5,429,902 | A | 7/1995 | Saito et al. | |
| 5,849,456 | A | 12/1998 | Matsumura et al. | |
| 6,077,636 | A * | 6/2000 | Moriki et al. | 430/110.3 |
| 6,617,091 | B2 | 9/2003 | Nishimori et al. | |
| 2002/0039699 | A1 | 4/2002 | Nishimori et al. | |
| 2003/0027072 | A1 | 2/2003 | Horiuchi et al. | |
| 2003/0036013 | A1 * | 2/2003 | Yamazaki et al. | 430/110.4 |
| 2003/0054269 | A1 * | 3/2003 | Yamazaki et al. | 430/110.3 |
| 2003/0059700 | A1 * | 3/2003 | Konya et al. | 430/108.6 |
| 2004/0043319 | A1 | 3/2004 | Horiuchi et al. | |

FOREIGN PATENT DOCUMENTS

| | | | |
|---|---|---|---|
| JP | 3-55562 | A | 3/1991 |
| JP | 5-119515 | | 5/1993 |
| JP | 6-208241 | | 7/1994 |
| JP | 8-44103 | | 2/1996 |
| JP | 10-26842 | | 1/1998 |
| JP | 11-95480 | A | 4/1999 |
| JP | 2001-66821 | | 3/2001 |
| JP | 2002-29730 | | 1/2002 |
| JP | 2002-116574 | | 4/2002 |
| JP | 2002-148848 | | 5/2002 |
| JP | 2002-148848 | A | 5/2002 |
| JP | 2002-287410 | | 10/2002 |
| JP | 2002-351142 | | 12/2002 |
| JP | 2002-365834 | | 12/2002 |
| JP | 2003-76058 | A | 3/2003 |
| JP | 2003-91093 | A | 3/2003 |
| JP | 2003-192940 | A | 7/2003 |
| JP | 2003-207938 | | 7/2003 |

OTHER PUBLICATIONS

Diamond, Arthur S & David Weiss (eds.) Handbook of Imaging Materials, 2nd ed. New York: Marcel-Dekker, Inc. (Nov. 2001) pp. 187-188.*
Japanese Office Action for Patent Application No. JP2003-361583 (with English Translation) mailed Jan. 8, 2008.
US Patent 5,849,456 corresponds to Japanese Patent Application 10-26842.
English Abstract for Japanese Patent Application No. 5-119515 dated May 18, 1993.
English Abstract for Japanese Patent Application No. 8-44103 dated Feb. 16, 1996.
English Abstract for Japanese Patent Application No. 2001-66821 dated Mar. 16, 2001.
English Abstract for Japanese Patent Application No. 2002-29730 dated Jan. 29, 2002.
English Abstract for Japanese Patent Application No. 2002-148848 dated May 22, 2002.
English Abstract for Japanese Patent Application No. 2002-287410 dated Mar. 10, 2002.
English Abstract for Japanese Patent Application No. 2002-365834 dated Dec. 18, 2002.
English Abstract for Japanese Patent Application No. 2003-207938 dated Jul. 25, 2003.
Japanese Office Action Response for Unexamined Japanese Patent Application Publication No. 2003-361583 dated Feb. 22, 2008 with English Translation.
Decision of Patent of the Japanese counterpart Unexamined Japanese Patent Application Publication No. 2003-361583 dated Apr. 8, 2008 with English Translation.

* cited by examiner

*Primary Examiner*—Christopher RoDee
(74) *Attorney, Agent, or Firm*—Cantor Colburn LLP

(57) ABSTRACT

A toner for developing electrostatic images which contains an external additive A containing an irregular-shaped metal oxide and having an average value of the feret's horizontal diameter of from 20 nm to 1370 nm, and an external additive B containing a hydrophobic particle having an average value of the feret's horizontal diameter of from 10 nm to 45 nm.

14 Claims, 5 Drawing Sheets

TONER PARTICLE WITHOUT CORNER

TONER PARTICLE WITH CORNER

TONER PARTICLE WITH CORNER

TONER FOR DEVELOPING ELECTROSTATIC LATENT IMAGES AND A PRODUCTION METHOD FOR THE SAME

BACKGROUND

1. Field of the Invention

The invention relates to a toner for developing electrostatic latent images and the method for produce the same.

2. Related Art

Recently, in the field of image formation by electrophotographic system, it is demanded to raise the compactness and the speediness. As the means for attaining such the objects, miniaturization of the units constituting such as the developing unit of the image forming apparatus is progressed.

For attaining such the miniaturization and speedup of the apparatus, the following properties are required to the constitution of the image forming apparatus such as the developing unit.

(a) The conveying of toner is stabled and the toner is smoothly supplied into the developing device.

(b) Suitable electrical charging amount is maintained by rapid rising up of electrical charging, and toner scattering and fog in non-image area are inhibited.

(c) The charging amount and the developing amount can be constantly and stably maintained with little aging variation such as burying of the external additive of toner since the developer receives strong stirring stress in the developing device by the small developing roller.

(d) The resistivity against heat of the toner is higher than that of the former toner since the cooling mechanism of the image forming apparatus is simplified.

As above-mentioned, the toner is exposed to severe conditions by the miniaturization and speed up of the apparatus. Therefore, a toner capable of forming a suitable image under such the condition is investigated. It has been tried in the investigation to attain the above objects (a) to (d) by improving the external additive.

For example, techniques are known in which inorganic powder having a specified BET surface area value treated by a silane coupling agent or silicone oil is used as the external additive, a planar fine particle is used as the external additive, or a substance having a chain or branched structure constituted by covalent bonded 6 to 500 fine particles is uses as the external additive.

However, the properties demanded by the inventors are not satisfied by the above external additives.

On the other hand, exact reproduction of digital images is required. For satisfying such the needs, miniaturize of the toner particle is investigated and a polymerization toner seems most suitable for miniaturized toner particle since the particle diameter of the polymerization toner can be controlled in the production process. It has been tried to attain high speed charging up by the small size developing unit by adding an external additive to the polymerization toner. However, a problem is posed that the external additive is easily released from the toner particle surface when the external stress such as that caused by stirring is applied since the adhering force of the polymerization toner particle with the external additive is weak.

Therefore, an external additive difficultly released from the polymerization toner particle surface has been investigated. However, one capable of fitting for the use in a small size image forming apparatus cannot be found yet, in which a large stress is applied on the occasion on the image formation.

Moreover, the electrophotographic system becomes to competed with light pressing work accompanied with the speedup and network formation thereof. Consequently, the formation of an image with a high resolving power and image quality is required. For satisfying such the requirements, it is tried to attain the high resolving power by a toner having small particle diameter.

The increasing in the relative surface area of the toner accompanied with the decreasing in the particle diameter causes a problem that the charging amount per init area is considerably increased and the stability of the developing amount is influenced.

And then the developing ability of the toner becomes instable, so that the high resolving power cannot be obtained even though the diameter of the toner particle is made small. Therefore, it is very difficult to output a high quality toner image. On such the background, techniques by improvement of the external additive such as the use of needle-like shaped titania or titania-including silica and techniques noting on the transferring ability and the resolving power are proposed.

However, these techniques are insufficient yet from the viewpoint of higher resolving power and stability of image expected by the inventors.

Besides, the technique for the polymerization toner suitable for making small the diameter of toner is considerably progressed, in which a technique of emulsion association is noted. One of the reasons of that is that the shape of the toner particle can be easily controlled and the particle diameter distribution of the toner can be controlled so as to be considerably sharp compared with the usual toner particle.

Furthermore, techniques in which resin particles are fixed on the toner particle or resin layer is provided on the toner particle surface have been proposed for making uniform the charging on the toner particle.

However, an image having high resolving power is difficultly obtained by the above techniques and expected effects are not always obtained even when the improvement of the external additive is applied in combination.

The polymerization toner causes the problem that the adhering and fixing strength with the external additive is weak and the external additive is easily released from the toner particle surface. As the reason of that, it is supposed that the toner particle produced by the polymerization method cannot strongly trap the external additive since such the particle has no corner and the surface of it is smooth.

According to such the background, an external additive which does not release from the toner particle surface and a toner stable in the charging amount, developing amount and transferring ability and constantly giving high resolving power are required.

The invention is attained on the above-mentioned back ground.

On a first aspect of the invention, an object of the invention is to provide a toner by which suitable image formation can be performed by an image forming apparatus corresponding to miniaturization and speedup. Namely, an first object of the invention is to provide a toner for developing electrostatic images employable for high speed image formation, which can be smoothly conveyed and electrically charged rapidly when the toner is supplied in the developing device.

On a second aspect of the invention, a second object of the invention is to provide a toner for developing an electrostatic image having durability so that the image formation can be performed stably without releasing of the external additive form the toner particle surface even when large stress is applied to the toner by stirring in a miniaturized developing device or burying the external additive into the toner particle.

On a third aspect of the invention, a third object of the invention is to provide a toner having high heat resistive stability so that the image formation can be stably performed in an apparatus in which the cooling mechanism of the apparatus is simplified.

On a fourth side of the invention, an object is to provide a toner for developing electrostatic images using an external additive suitable for a polymerized small diameter toner by which the electrical charging amount, the developing amount and the transferring ability are stabilized and high resolving power of image can be obtained.

SUMMARY

A first aspect is a toner for developing electrostatic images including an external additive A having an average feret's horizontal diameter of from 20 nm to 1370 nm and containing irregular shaped metal oxide and an external additive B containing a hydrophobic particle having an average feret's horizontal diameter of from 10 nm to 45 nm.

A second aspect is a toner for developing electrostatic images in which at least one of external additives has a primary particle diameter of from 25 nm to 1450 nm and a true density of from 2.5 g/cm$^3$ to 4.8 g/cm$^3$, and the surface of the external additive has an amorphous silica area and a metal oxide area.

DETAIL DESCRIPTION OF THE EXEMPLARY EMBODIMENTS

Figure 1:
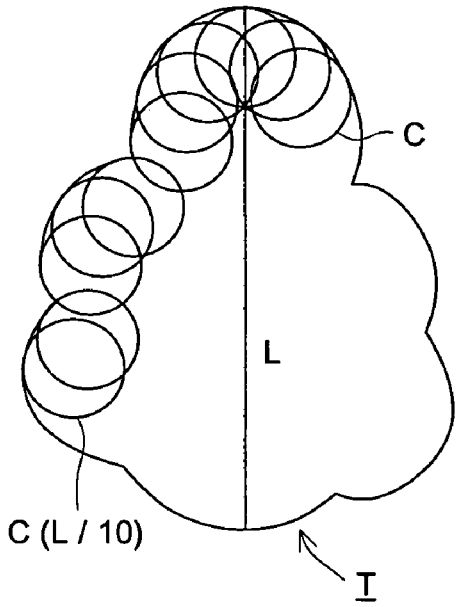
In FIG. 1, (a) shows a projection image of an example of toner particle having no corner, and (b) and (C) each show a projection image of an example of toner particle having a corner.
Figure 1:
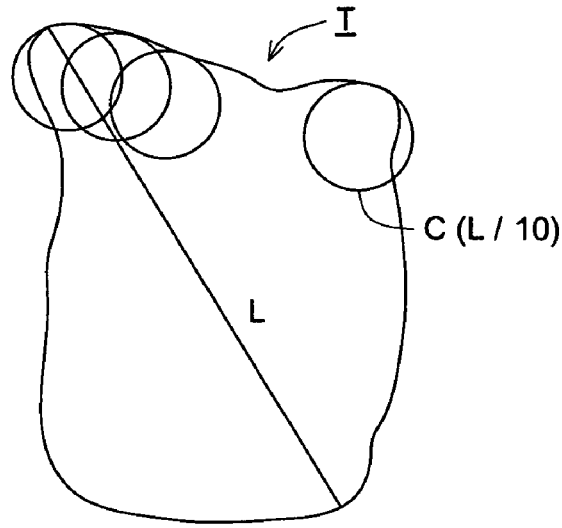
Figure 1:
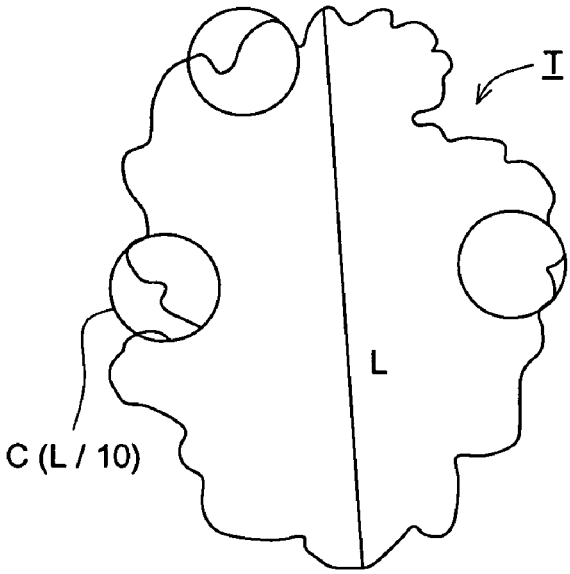

It is found by the inventors that the following constitutions 1 to 5 are particularly preferable for the above-described objects.

(1) A toner for developing an electrostatic image containing a toner particle containing a resin and a colorant and mixed with an external additive, wherein the external additive contains an external additive A containing a metal oxide and having an average feret's horizontal diameter of from 20 nm to 1370 nm and an irregular shape and an external additive B containing a hydrophobic particle having a feret's horizontal diameter of from 10 nm to 45 nm.

(2) The hydrophobic particle contained in the external additive A is one treated by cyclic silazane compound.

(3) The metal oxide contained in the external additive is one treated by a silazane compound.

(4) The metal oxide is at least one selected from the group of oxides consisting of titanium oxide, aluminum oxide and zirconium oxide.

(5) A method for producing a toner for developing an electrostatic image containing a toner particle mixed with an external additive containing a metal oxide, wherein the metal oxide contained in the external additive is one formed in the presence of amorphous silica.

According to the above constitution, a toner for developing electrostatic images and the producing method there of can be provided, by which the conveying ability of toner and the rising up of the electrical charging is made suitable, the scattering of toner and the burying of the external additive particle into the toner particle are prevented, and the resolving power of the formed image is made high even when the toner particle diameter is small; and toner itself contains the external additive giving high stability to the toner.

Namely, a toner for developing an electrostatic image and the producing method thereof can be provided, by which the conveying ability of toner and the rising up of the electrical charging is made suitable, the scattering of toner and the burying of the external additive particle into the toner particle are prevented, and the stability of the consumption amount of the toner on the occasion of image formation and the resolving power of the formed image are made high even when the toner particle diameter is small according to the above described constitutions 1 to 5.

It is investigated by the inventor noting on the charging property of the external additive to stabilize the developing amount of the toner. As a result of that, it is found that the electrical charging amount can be stably maintained not relating to the time and strength of the stirring to the small diameter toner by using an additive C having a primary particle diameter of from 25 nm to 1450 nm, a true density of from 2.5 g/cm$^3$ to 4.8 g/cm$^3$ and an area of amorphous silica and that of metal oxide on the surface thereof.

Moreover, it is found that the problem of contamination of the charging member by the carrier can be solved since the electrical charge is stably maintained and the external additive is difficultly released from the toner particle surface employing the external additive C.

Though the reason of that the electrical charging amount is stabilized and sustained at a constant level is not cleared yet, it is supposed that the area of the amorphous silica as a charging site rapidly raises the electrical charging amount of the toner by the designated charging amount and the area of the metal oxide is functions as a leaking site and suitably leaks excessive electrical charge at the amorphous silica area so as to maintain the electrical charging at the optimum amount.

It is found that the external additive C has an effect to prevent releasing of the additive particle from the toner particle surface by making the true density of the external additive C to 2.5 g/cm$^3$ to 4.8 g/cm$^3$, preferably from 2.9 g/cm$^3$ to 4.5 g/cm$^3$, and the primary particle diameter to 25 nm to 1450 nm. Particularly, it is confirmed that the external additive C is preferred as the external additive for the polymerization toner having rounded shape without any corner.

As above-described, it is found out that the external additive C displays surprising effects such as that sufficient adhering strength can be obtained and the problem of releasing of the external additive is solved when the additive is applied to the polymerization toner relatively spherical without corner, of course to usual crushed toner particle.

The following (6) to (8) are at least preferable constitution.

(6) A toner for developing electrostatic images containing a resin, a colorant and an external additive particle in which at least one kind of the external additive particle has an average primary particle diameter of from 25 nm to 1450 nm and a true density of from 2.5 g/cm$^3$ to 4.8 g/cm$^3$, and the surface of the external additive particle has an amorphous silica area and a metal oxide area.

(7) The metal oxide area has a crystal structure area.

(8) The toner particle is prepared by a process for fixing a resin particle onto the surface of a mother particle in which the glass transition point of the resin particle (Tgs) is higher than that of the mother particle (Tgm).

Such the constitution particularly stabilizes the electrical charging amount, the developing amount and the transferring ability of the toner and contributes to provide the toner for developing electrostatic images constantly giving high resolving power.

The external additive is a composite external additive suiting with the polymerization toner having small diameter, and the electrical charging amount, the developing amount and the transferring ability of the toner can be stabilized by the inclusion of such the external additive in the toner and the toner for developing electrostatic image constantly giving high resolving power can be provided.

The each of the constitution elements are each described in detail below.

<<External Additive>>

The external additive 1 is described below.

It is found out that the suitable raising up of electrical charging and good conveying ability can be obtained and the external additive is not released form the toner particle surface so as to perform the stable image formation by the toner according to the invention containing the external in which the external additive containing the metal oxide particle having an amorphous particle shape an average value of feret's horizontal diameter of from 20 nm to 1370 nm is employed even when a developing roller having a diameter of 7 mm is employed and the image formation is carried out at a rate of 70 sheets per minute.

It is supposed that such the effects can be displayed because the adhering ability represented by the electrostatic attractive force between the toner particle and the external additive becomes suitable by controlling the shape and the size of the metal oxide particle contained in the external additive.

It is preferable that the particle has a structure constituted by unifying a plurality of flat or planar shaped particles through covalent bonds.

Though the shape of the metal oxide particle is not a factor for displaying the effects of the invention, oxides of titanium, tin, zirconium and aluminum are cited as the metal oxide in the external additive A from the viewpoint of the production.

As later-mentioned, the external additive (A) is produced by a process in which the metal oxide particle is formed in the presence of a hydrophobilizing-treated fine particle of silica. In concrete, a layer of the metal oxide is formed on the surface of the hydrophobilizing-treated fine silica particle and then the metal oxide layer is released from the fine silica particle surface and condensation reaction is performed to grow the particle so as to obtain the irregular-shaped metal oxide having the foregoing average feret's horizontal diameter.

(Additive B)

Moreover, it is found out that the effects of the invention can be more certainly displayed by employing an additive B containing a hydrophobic particle having an average feret's horizontal diameter of from 10 nm to 45 nm additionally to the external additive A. The additive B is preferably not amorphous. The shape of that is needle-like, spherical and oval-shaped are employable.

The additive B is a usual fluidizing agent. Ones having the fluidity such as amorphous silica, titanium oxide and aluminum oxide are preferable example. The amorphous silica added with the later-mentioned cyclic silazane compound is preferably employed since such the silica displays an effect of raising the stability of electrical charge.

The cyclic silazane compound adding treatment to the amorphous silica (the hydrophobic property is provided to the silica by this treatment), for example, from 5 to 25 parts, preferably from 8 to 20 parts, of the cyclic silazane is added to 100 parts of the amorphous silica and mixed for 15 to 30 minutes at a room temperature in nitrogen atmosphere.

And then the stirring is continued for 14 to 18 hours at a temperature of from 82° C. to 98° C. in the nitrogen atmosphere. Thus hydrophobic silica particle tan be obtained.

It is found that the conveying ability of the toner is considerably improved by the addition of the external additive B containing the hydrophobic particle having an average feret's horizontal diameter of from 10 nm to 45 nm additionally with the external additive A.

It is supposed that such the effect is caused by provision of fluidity to the toner particle by the adhesion of the external additive B on the surface of the external additive A because which has irregular shape.

Furthermore, it has be found out that the burying of the external additive at the surface of the toner is inhibited under a condition in which mechanical stress is largely applied such as the condition in the developing device having a small diameter developing roller. It is also supposed that the impact at the time of the collision of toner particles with together is substantially eased by the provision of the fluidity by the external additive B adhering on the surface of the external additive A so that the burying of the external additive on the toner surface is inhibited.

(Measurement of Hydrohobicity of Hydrophobic-Treated Particle)

Though the degree of the hydrophobic-treatment of the particle is not specifically limited, a methanol wettability of from 40 to 100 is preferable. The methanol wettability expresses the wetting ability to methanol.

In the measuring method, 50 ml of distillated water is put into a 200 ml beaker and 0.2 g of inorganic fine particles to be measured is added. Methanol is added from a burette, the pointed end of which is immersed in the liquid, until the entire particles are wetted while slowly stirring. The hydrophobicity is calculated according to the following expression, in which a (m1) is the amount of the methanol necessary for completely wet the inorganic particles.

$$\text{Hydrophobicity}=(a/(a+50))\times 100$$

(Feret's Horizontal Diameter and Average Value of Feret's Horizontal Diameter)

The definition and the measuring method of the feret's horizontal diameter of the external additives A and B and the average value of each of the feret's horizontal diameters are described below.

The feret's horizontal diameter is defined by the particle diameter measured under the condition shown in the later-mentioned FIG. 5.

The feret's horizontal diameter of the irregular-shaped metal oxide contained in the external additive A or the hydrophobic particle contained as the external additive B is calculated by analyzing of a photographic image thereof taken by a high resolving power transmission type electron microscope (HR-TEM) by an image analyzing apparatus available on the market (Luzex F, manufactured by Nihon Nireco Co., Ltd.).

The average value of the feret's horizontal diameter can be obtained by arithmetic averaging the feret's horizontal diameters of optionally selected 200 particles. The feret's horizontal diameter is measured by the distance of two parallel lines tangent to the profile of the particle, the two parallel lines are each crossing at right angle with the horizontal direction (the horizontal direction is the x-axis direction of the photograph) of photograph (may be photographic image) taken by the high resolution transmission type electron microscope (HR-TEM).

(Measurement of the Feret's Horizontal Diameter)

Figure 5:
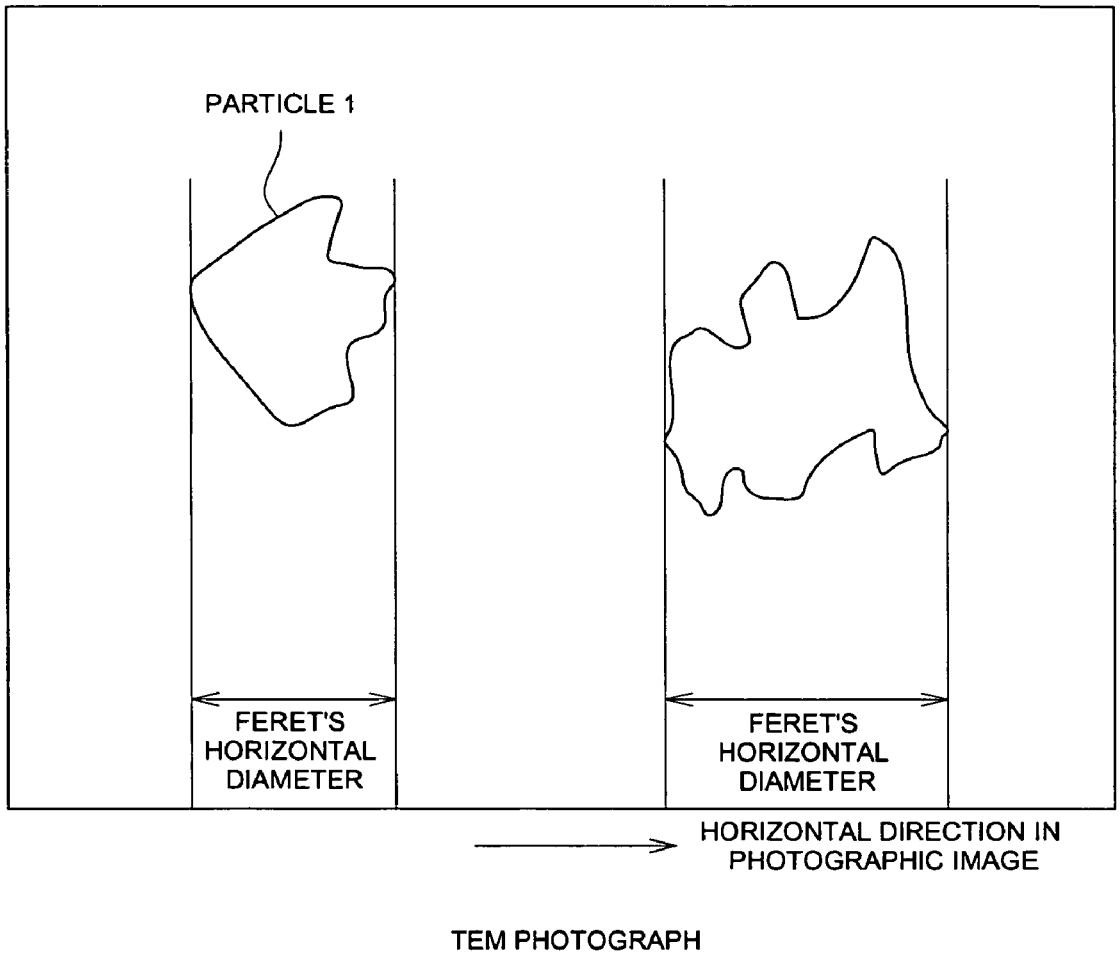
FIG. 5 is schematic drawing showing the feret's horizontal diameter of each of Particle 1 and Particle 2.

An example of measurement of the-feret's horizontal diameter is described referring FIG. 5.

FIG. 5 is a schematic drawing showing the feret's horizontal diameter of each of a particle 1 and particle 2.

It is understood that the feret's horizontal diameter of each of the particle 1 and particle 2 is represented by the distance of the two parallel lines, which is tangent to the particle.

In the measurement, two parallel lines crossing at right angles to the x-axis of the photograph (a side of square or rectangular photograph is defined as the x-axis) are drawn so that the particle is tangent to each of the parallel lines and the distance of the parallel lines is defined as the feret's horizontal diameter.

(Preferable Range of the Feret's Horizontal Diameter)

The average value of the feret's diameter horizontal diameter of the irregular shaped metal oxide contained in the additive A is from 20 nm to 1370 nm, preferably from 50 nm to 1370 nm, preferably form 50 nm to 1206 nm, more preferable from 50 nm to 735 nm.

(Cyclic Silazane Compound)

Cyclic silazane compounds represented by the following Formula (1) are preferably employed.

Formula (1)

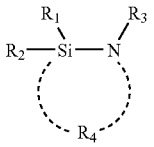

In the formula, $R_1$ and $R_2$ are each independently a hydrogen atom; a halogen atom such as a chlorine atom, a bromine atom, a fluorine atom and an iodine atom; an alkyl group such as a methyl group, an ethyl group, a propyl group, a butyl group, a pentyl group and an octyl group; an aryl group a phenyl group and a naphthyl group; or an aryloxy group such as a phenyloxy group and a naphthyloxy group.

$R_3$ is a hydrogen atom, a —$(CH_2)_nCH_3$ group (wherein n is an integer of from 0 to 3); a —$C(O)(CH_2)_nCH_3$ (wherein n is an integer of from 0 to 3); a carbamoyl group; an alkyl-substituted carbamoyl group such as an ethylcarbamoyl group and a propylcarbamoyl group; or a —$C(O)N((CH_2)_nCH_3)(CH_2)_mCH_3$ group (wherein n and m are each an integer of from 0 to 3).

$R_4$ is a $((CH_2)_a(CHX)_b(CYZ)_c)$ group, wherein X, Y and Z are each an hydrogen atom such as a chlorine atom, a bromine atom, a fluorine atom and an iodine atom; an alkyl group such as a methyl group, an ethyl group, a propyl group, a butyl group, a pentyl group and an octyl group; an alkoxy group such as a methoxy group, an ethoxy group, a propoxy group and a butoxy group; an aryl group such as a phenyl group and a naphthyl group; or an aryloxy group such as a phenyloxy group and a naphthyloxy group. a, b and c are each an integer of from 0 to 6 provided that the sum of a, b and c is an integer of from 2 to 6.

Among the compounds represented by Formula (1), the compound most preferably employed is a compound represented by the following structural formula.

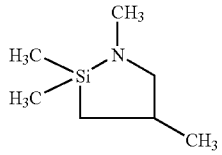

The hydrophobic silica employed as the external additive B adheres to the irregular-shaped additive A, and is able to give higher fluidity to the toner particle than the fluidity obtained by the silica directly adhering to the toner particle comprising of the resin and the colorant. Moreover, the hydrophobic silica shows an effect of preventing the burying of the additive A into the mother toner particle surface.

It is confirmed that sufficient adhering strength with the polymerization toner relatively spherical without corner, of course to usual crushed toner particle can be obtained by the combination use of the additive A and additive B each having the above-described characteristics and the releasing of the external additive can be considerably inhibited.

(Irregular-Shaped Metal Oxide Contained in the Additive A)

Though the shape of the metal oxide particle is not specifically limited, the preferable irregular shape (also referred to as the state) is tabular or a coagulated shape of some particles each having a curved face such as a broken piece of shell.

It has been confirmed that the presence of a crystalline area at least a part of the particle is preferably for accelerating the electrical charging.

The concrete compounds preferably employed as the metal oxide is titanium oxide, aluminum oxide and zirconium oxide.

(Crystalline Structure)

It is preferable that the irregular-shaped metal oxide contained in the additive A partially has crystalline structure, and the crystalline structure can be observed as the occurrence of interference fringe by a high resolution transmission electron microscope in a phase contrast mode.

The method for confirming the crystalline structured area is described below.

(Method for Confirming the Crystal Structure of the Metal Oxide)

The crystal structure of the metal oxide can be confirmed by exampling the external additive particles on a grid mesh on which a micro grid is pasted and observing the transmission image using a TEM (transmission type electron microscope), preferably a high resolution transmission electron microscope (HR-TEM) such as a field emission type emission electron microscope (FE-TEM).

When the crystalline structure is in the metal oxide contained in the external additive, the electron rays passed through the sample are separated to transmitted waves and diffracted waves.

A lattice image reflecting the crystallinity of the sample can be observed by the interference image of the transmission waves and the diffraction waves. Sufficiently detectable contrast can be obtained when the scattering amount is small such as that by a single atom since the phase contrast forming the interference image is proportional with the diffraction width. Therefore, high resolution observation of the lattice image can be performed. As to the observation method of the lattice image, description of *S. Horiuch* "Kou Bunnkai Nou Denshi Kennbikyou (High Resolution Electron Microscope)", Kyouritsu Shuppan, 1988, can be referred.

In the case of the external additive A, the lattice image can be frequently observed in the metal oxide area on the surface of the particle by observation using the FE-TEM (the accelerating voltage is set at 200 kV). The lattice images are not observed in the circumference area of the area where the lattice image is observed, therefore it is confirmed that the presence of a domain having the crystalline substance (crystalline structure) in an amorphous matrix.

<<Preparation Method of the External Additive A>>

The method for preparing the external additive A is described below.

In concrete, the external additive A is prepared by a process in which the surface of the hydrophobilized silica fine particle, preferably employing the silica fine particle as a medium, is covered with oxide of titanium, tin, zirconium or aluminum in the presence of an alkali solution.

For example, titanium sulfate and titanium tetrachloride are employable as the titanium source (a titanium compound functioning the source for supplying the titanium oxide); tin chloride and stannous sulfate as the tin source (a tin compound functioning the source for supplying the tin oxide); zirconium oxochloride, zirconium sulfate and zirconium nitrate are employable as the zirconium source (a zirconium compound functioning the source for supplying the zirconium oxide); aluminum sulfate and sodium aluminate are employable as the aluminum source (an aluminum compound functioning the source for supplying the aluminum oxide); they may be employed singly or in an optional combination.

The temperature of the slurry on the occasion of covering the silica fine particle surface by the hydroxide or oxide of titanium, tin, zirconium or aluminum is preferably from 40 to 85° C.

On the occasion of the covering, the slurry is added with an acid or an alkali, and stirred and stood, and then neutralized to become the pH to from 4 to 9, preferably from 5 to 7 by the alkali. Sodium hydroxide, potassium hydroxide, sodium carbonate, ammonia water and ammonia gas are employable as the alkali for the neutralization.

Though the metal oxide, namely titanium oxide, tin oxide, zirconium oxide or aluminum oxide, once adheres on the surface of the hydrophobic silica in a layer form by such the treatment, the metal oxide is released from the hydrophobic silica surface and condensation reaction is started since the adhering force is weak.

Thus grown metal oxide particle is treated by alkoxysilane, silicone oil or cyclic silazane together with the hydrophobic silica and dried, and then used by mixing with the toner. When alkoxysilane is used as the silarie coupling agent, the pH of the slurry is controlled to from 2 to 6, preferably from 3 to 6, and a designated amount of alkoxysilane is added to the slurry, and the hydrolysis and condensation reaction is performed at a slurry temperature of from 20 to 100° C., preferably from 30 to 70° C.

The metal oxide may also be employed which is prepared by that hydrophilic silica is partially hydrophobilized by 4 to 40% by weight of alkoxysilane and mixed while applying shearing force so as to peel off the metal oxide from the surface of the silica. As the apparatus capable of applying the shearing force, a wheel type kneading machine, a ball type kneading machine, blade type kneading machine and a roller type kneader machine are applicable and the wheel type kneading machine is more effectively employed. The wheel type kneading machine includes an edge runner (synonym for Mixmaler, Simpson mill and sand mill), Multimal, Stotz mill, wet pan mill, Coner mill and Ringmaler; and the edge runner, multimal, Stotz mill, wet pan mill and Ringlamer are preferable. The Example of the ball type kneading machine is a vibration mill, that of blade kneading machine is Henschel mixer, planetary mixer and Tauner mixer, and that of the roller type kneading machine is an extruder.

The condition at the mixing and stirring for peeling the metal compound from the medium such as silica particle is suitably controlled within the range of a line load of from 19.6 to 1,960 N/cm (from 2to 200 kg/cm), preferably from 98 to 1,470 N/cm (from 10 to 150 kg/cm), and more preferably from 147 to 980 N/cm (from 15 to 100 kg/cm), and a treating time of from 5 minutes to 24 hours, and preferably from 10 minutes to 20 hours. The stirring rate may be suitably controlled within the range of from 2 rpm to 2,000 rpm, preferably from 5 rpm to 1,000 rpm, and more preferably from 10 rpm to 800 rpm.

Though the silica particles employed as the medium and the irregular-shaped metal oxide particles are preferably separated by a fine crushing machine having a classifying device, the mixture may be used intact state (in the state of mixture of the silica particles and the irregular-shaped metal oxide).

(Content of the Irregular-Shaped Metal Oxide in the External Additive A)

The content of the irregular-shaped metal oxide in the external additive A is preferably not less than 20% by weight, and more preferably not less than 80%, of the whole amount of the external additive A.

(Preparation Method of the Metal Oxide Particle)

As the metal oxide, one prepared by a flame burning method is preferably employed. Basically, a metal coupling agent such as a silane coupling agent containing no halogen is mixed in a liquid state and sprayed into flame. In the control of the diameter of the domain, the domain diameter becomes finer accompanied with increasing of the halogen amount, and the domain-matrix structure cannot be formed in the presence of excessive halogen since the phase separation does not occur. The amount of halogen is roughly from 0 to 4% by weight. Though the temperature and the domain diameter can be controlled by the temperature of the flame, it is better that the production is performed after the decision of the condition after preliminary test since the optimum condition is varied according to the combination.

Figure 4:
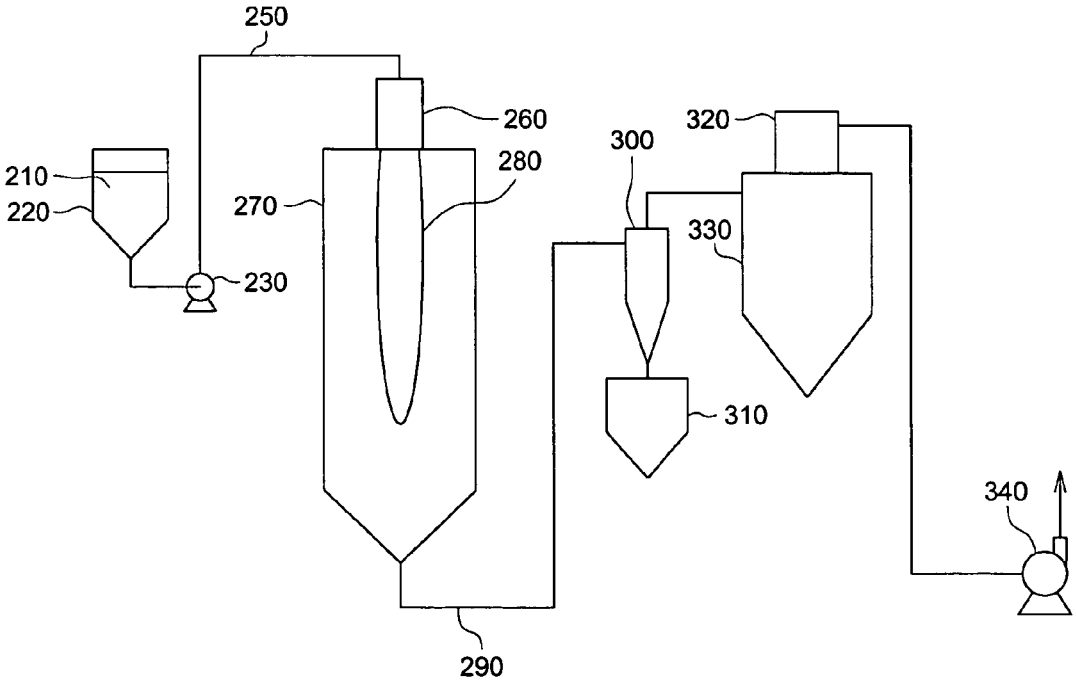
FIG. 4 shows an example of production equipment of metal oxide particles.

FIG. 4 shows a schematic cross section of the vertical burning furnace which is equipment for flame hydrolyzing siloxane vapor supplied to the burner.

In FIG. 4, the raw materials (a mixture of metal coupling agents) 210 is introduced from a raw material tank 220 to a main burner 260, a spraying nozzle is attached at the end thereof, through a metering supplying pump 230 and a introducing pipe 250. Siloxane 210 is sprayed into a burning furnace 270 and burning flame 280 is formed by lighting with a supporting flame. Metal oxide particles formed by the burning are cooled in a smoke pipe 290 together with exhaust gas, and separated by a cyclone 300 and a bag filter 320 and caught in a collecting container 310 and 330. The exhaust gas is removed by an exhauster 340.

(2) <<External Additive 2 (Composite External Additive)>>

As at least one of the external additives, an external additive is employed which has a primary particle diameter of from 25 nm to 1450 nm, a true density of from 2.5 g/cm$^3$ to 4.8 g/cm$^3$, and the surface has an area of amorphous silica and an area of metal oxide. Such the external additive is referred to as a composite external additive in the invention.

(Primary Particle Diameter)

The primary particle diameter of the external additive is preferably from 35 nm to 500 nm, and more preferably from 40 to 300 nm, for controlling so that the electrical charge on the toner surface is stabilized and the composite additive itself is stably held on the toner particle surface. The particle diameter of the composite external additive used in the invention is a figure of nm (number average primary particle diameter), and the diameter is measured by the high resolution transmission electron microscope (HR-TEM).

(True Density)

The true density of the composite is measured by a true density measuring apparatus Volumeter VM-100, manufactured by Estec Co., Ltd. The true density is the weight per unit volume of the substance constituting the particle.

(Structure of the Composite External Additive)

The "composite external additive" is a composite particle having both of the amorphous silica area and the metal oxide area on the particle surface (also called as the core particle surface). The fact that the particle has both of the amorphous silica and the metal oxide area is confirmed by that both of the amorphous silica and the metal oxide area are observed on the particle surface when the composite external additive surface is observed by the later-mentioned transmission electron microscope (TEM).

In the composite external particle, it is preferable that a part or whole surface of the core particle (such as fine particles of silica, titania and alumina) is constituted by the amorphous silica area and the metal oxide area, and the amorphous silica area and the metal oxide area are formed on the entire surface of the core surface. The core particle is preferably composed of amorphous silica from the viewpoint of the electrical charge maintaining.

(Crystalline Structure)

The metal oxide area of the composite external additive particle is preferably has the crystalline structure. The crystalline structure displays interference lines in the observation by the high resolution transmission microscope in the phase contrast mode.

The confirmation method of the crystalline structural area is described below.

(Confirmation Method of the Crystal Structure of the Metal Oxide Area on the Surface Phase of the Composite External Additive)

The crystalline structure of the metal oxide can be confirmed by exampling the external additive particles on a grid mesh on which a micro grid is pasted and observing the transmission image using a TEM (transmission type electron microscope), preferably a high resolution transmission electron microscope (HR-TEM) such as a field emission type emission electron microscope (FE-TEM).

When the crystalline structure is in the metal oxide contained in the external additive, the electron rays passed through the sample are separated to transmitted waves and diffracted waves.

A lattice image reflecting the crystallinity of the sample can be observed by the interference image of the transmission waves and the diffraction waves. Sufficiently detectable contrast can be obtained when the scattering amount is small such as that by a single atom since the phase contrast forming the interference image is proportional with the diffraction width. Therefore, high resolution observation of the lattice image can be performed. As to the observation method of the lattice image, description of *S. Horiuch* "Kou Bunnkai Nou Denshi Kennbikyou (High Resolution Electron Microscope)", Kyouritsu Shuppan, 1988, can be referred.

(Surface of the Composite External Additive)

The surface of the composite external additive is the outline portion observed by the transmission electron microscope (TEM). The metal oxide area is usually appeared as darker portion compared with the amorphous silica; the composition of it can be analyzed by a fluorescent X-ray analyzing apparatus attached to the TEM.

In the case of the composite external additive, the lattices images are partially observed in the metal oxide area on the surface of the composite particle are observed by the FE-TEM (accelerating voltage is set at 100 kV).

The lattice images are not observed in the circumference area of the area where the lattice image is observed, therefore it is confirmed that the presence of a domain having the crystalline substance (crystalline structure) in an amorphous matrix.

<<Preparation Method of the Composite External Additive>>

Though there are applicable various methods for preparing the composite external additive without any limitation, an example is described below, in which amorphous silica is employed as the starting raw material.

(a) Preparation of Amorphous Silica Powder

Very small amount of a hydrophobilizing agent such as an alkoxysilane or a titanium coupling agent is added to hydrophilic silica particles or their slurry for partially hydrophobilizing the surface of the silica particle (partial hydrophobilization can be controlled by the using amount of the hydrophobilizing agent). In the invention, the adding amount of the hydrophobilizing agent is preferably from 2.0% to 7.5% by weight per 100 parts by weight of the hydrophilic silica particles.

After that, a solution of titanium tetrachloride, tin chloride, stannous sulfate, zirconium oxochloride, zirconium sulfate, zirconium nitrate, aluminum sulfate or sodium aluminate is added in an aqueous medium having a pH of from 1 to 4, and the pH is raised to about 5.6 to precipitate the metal oxide onto the hydrophilic silica particles.

Thus the slurry of the silica particles on which at least one oxide of titanium, tin, zirconium and aluminum adhering in an amount of from 5% to 28% by weight is prepared, and then the solid component of the slurry is subjected to hydrophobilizing treatment by large amount of the hydrophobilizing agent to hydrophobilize the whole particles. Thereafter, the slurry is neutralized by an alkali and excessive alkoxysilane is removed, and then the slurry is filtrated, washed, dried and crushed. The adding amount of the hydrophobilizing agent in this process is preferably from 15.0% to 40.05% by weight.

The drying temperature after the filtration and washing is preferably from 120 to 190° C. The composite external additive is preferably powdered by a finely crushing machine such as a jet mill since the composite external additive after drying is frequently weakly coagulated.

The reaction can be controlled by lowering the temperature of the slurry. The preparation can be performed by controlling the temperature to from 4° C. to 17° C. on the occasion of forming the metal oxide area onto the surface of the hydrophilic silica fine particles.

By making the slurry temperature to the foregoing value, the adhesion of the inorganic metal hydrate compound becomes not uniform so that the coexisting state of the amorphous silica area and the metal oxide area is formed on the silica particle surface.

The amorphous silica powder to be employed as the starting raw material is one prepared by burning a silicon halide or an organic silicon compound in flame of hydrocarbon gas such as propane gas and methane gas in the vertical burning furnace shown in FIG. 4.

FIG. 4 shows a schematic cross section the vertical burning furnace which is equipment for flame hydrolyzing siloxane vapor supplied to the burner.

In FIG. 4, the raw materials (a mixture of metal coupling agents) 210 is introduced from a raw material tank 220 to a main number 260, a spraying nozzle is attached at the end thereof, through a metering supplying pump 230 and a introducing pipe 250. Siloxane 210 is sprayed into a burning furnace 270 and burning flame 280 is formed by lighting with a supporting flame. Metal oxide particles formed by the burning are cooled in a smoke pipe 290 together with exhaust gas, and separated by a cyclone 300 and a bag filter 320 and caught in a collecting container 310 and 330. The exhaust gas is removed by an exhauster 340.

(Raw Material of the Metal Oxide): for the Metal Oxide Area Formation

As the raw material of the metal oxide, titanium sulfate, and titanium tetrachloride, thin chloride and stannous sulfate as the tin source, zirconium oxochloride, zirconium sulfate and zirconium nitrate as the zirconium source, and aluminum sulfate and sodium aluminate as the aluminum source can be employed singly or in an optional combination.

<<Employable External Additive>>

The composite external additive (the external additive having the amorphous silica area and the metal oxide area) may be employed together with the following known external additive.

Known inorganic fine particle can be employed as the known external additive. In concrete, silica fine particle, titania fine particle and alumina fine particle are preferably usable. These fine particles are preferably hydrophobic.

Concrete examples of the silica fine particle are R-805, R-976, R-974, R-972, R-812 and R-809 marketed by Nihon Aerogel Co., Ltd., HVK-2150 and H-200 marketed by Hoechst Co., Ltd., and TS-720, TS-530, TS-610, H-5 and MS-5 marketed by Cabot Co., Ltd.

Concrete examples of titania fine particle are T-805 and T-604 marketed by Nihon Aerogel Co., Lt., MT-100S, MT-100B, MT-500BS, MT-600, MT-600SS and JA-1 marketed by Teika Co., Ltd., TA-300S, TA-500, TAF-130, TAF-510 and TAF-510T marketed by Fuji Titan Co., Ltd., and IT-S, IT-OA, IT-OB and IT-OC marketed by Idemitsu Kosan CO., Ltd.

Concrete examples of the alumina fine particle are RFY-C and C-604 marketed by Nihon Aerogel Co., Ltd., and TTO-55 marketed by Ishihara Sangyo Co., Ltd.

Spherical fine particle having a number average primary particle diameter of from 10 nm to 2,000 nm is usable as the organic external additive. Polystyrene and styrene-methyl methacrylate copolymer are usable as the constituting material of such the organic fine particle.

To the external additive, the adding processes the same as that for the foregoing slipping agent can be applied. Various mixer such as a tabular mixer, Henschel mixer, Tauner mixer and V type mixer are applicable for adding the external additive.

<<Toner for Developing Electrostatic Image>>

The toner for developing electrostatic image is described below.

(Diameter of the Toner)

The diameter of the toner for developing electrostatic image is described below.

The diameter of the toner is preferably from 3 μm to 10 μm, and preferably from 3 μm to 8 μm in median diameter (D50) based on number. The particle diameter can be controlled by the concentration of the coagulating agent, the adding amount of organic solvent, the fusing time and the composition of the polymer in the later-mentioned producing method of the toner.

By making the number based median diameter (D50) to 3 μm to 10 μm, the fine toner particles having strong adhesion force causing offset by scattering and adhering to a heating member are reduced, and the transferring efficiency of the toner is raised so that the image quality of the halftone, fine line and dot is improve.

The number based median diameter D50 of the toner can be measured by Coulter Counter TA-II and Coulter Multisizer, both manufactured by Coulter Beckman Co., Ltd., and SD2000, manufactured by Sysmex Co., Ltd.

In the invention, Coulter Multisizer was used, to which an interface for outputting the particle diameter distribution, manufactured by Nikkaki Co., Ltd., and a personal computer were connected. An aperture of 100 μm was used in the Multisizer and the number distribution of the toner of not less than 2 μm (for example from 2 μm to 40 μm) was measured and the particle diameter distribution and the median diameter (D50) were calculated.

(Average of the Circular Degree of the Toner Particles)

As to the shape of the toner, the average of the circular degree (shape coefficient) expressed by the following expression is preferably from 0.94 to 0.99, and more preferably from 0.963 to 0.981 when 2,000 particles of the toner each having a diameter of not less than 1 μm are measured.

$$\text{Circular degree}=(\text{Circumference length of corresponding circle})/(\text{Circumference of projection image of toner particle})=2\pi\times(\text{Projection area of particle}/\pi)^{1/2}/(\text{Circumference length of projection image of toner particle})$$

In the above, the "corresponding circle" is a circle having an area the same as that of the projection image of the toner particle, and the circle corresponding diameter is the diameter of the corresponding circle.

The circular degree can be measured by FPIA-2000, manufactured by Sysmex Co., Ltd. The corresponding circle diameter is defined by the following expression.

$$\text{Corresponding circle diameter}=2\times(\text{Projection area of particle}/\pi)^{1/2}$$

(Shape Coefficient of the Toner Particle)

The shape coefficient of the toner particle is described below.

The shape coefficient of the toner is expressed by the following expression and represents the circularity of the toner particle.

$$\text{Shape coefficient}=((\text{Maximum diameter}/2)^2\times n)/\text{Projection area}$$

The maximum diameter is the width of the toner particle determined by the largest distance of two parallel lines each are tangent to the different sides of the projected profile image on a plane of the toner particle. The projection area is an area of the projection image on a plane of the toner particle.

The shape coefficient is measured by taking a photograph of toner particles by a scanning electron microscope with a magnitude of 2,000, and analyzing the photographic image by Scanning Image Analyzer, manufactured by Nihon Denshi Co., Ltd. The measurement is performed with respect to 100 particles and the shape coefficient is determined according to the above expression.

It is preferable in the toner particles constituting the toner for developing electrostatic images that the particles have the shape coefficient within the range of from 1.0 to 1.6, account for not less than 65% in number, and more preferably not less than 70% in number. It is more preferably that the toner particles having the shape coefficient of from 1.2 to 1.6 account for not less than 65%, and more preferably not less than 70%.

When the toner particles have the shape coefficient of from 1.0 to 1.6 account for not less than 65% in number, the problem of occurrence of ghost developing is difficultly caused since the triboelectric charging by the developer conveying member becomes uniform and accumulation of excessive charged toner is prevented and the toner on the developer conveying member is easily exchanged. Moreover, the toner particle becomes difficultly crushed so as to reduce the contamination of the charge providing member and secondary effects such as that the charging ability of the toner are stabilized is enhanced.

The method for controlling the shape coefficient is not specifically limited. For example, the toner controlled in the shape coefficient into the range of from 1.0 to 1.6, or 1.2 to 1.6, is prepared by a method such as that by supraying the toner particles into a hot gas stream, that by repeatedly applying mechanical energy by impact force to the toner particles in a gas phase, or that by adding the toner particles into a solvent capable of not dissolving the toner particle and circling the mixture. Thus prepared toner particles are added to a usual toner so that the ratio of the prepared toner is made into the range according to the invention. Furthermore, a method can be applied in which the shape coefficient of the toner is entirely controlled in the production step of a polymerization toner so that the shape coefficient is within the range of from 1.0 to 1.6, or 1.2 to 1.6, and resultant toner is added to a usual toner.

(Variation Coefficient of the Shape Coefficient of the Toner Particle)

The variation coefficient of the shape coefficient of the toner particles is calculated according to the following expression.

$$\text{Variation coefficient (\%)}=(S_1/K)\times 100$$

In the expression, $S_1$ is the standard deviation of the shape coefficients of 100 toner particles and K is the average of the shape coefficients.

In the toner particles constituting the toner, the variation coefficient of the shape coefficient is preferably not more than 16%, and more preferably not more than 14%. When the variation coefficient of the shape coefficient is not more than 16%, the distribution of the charging amount is made sharper and the image quality is improved.

For uniformly controlling the shape coefficient and the variation coefficient of the shape coefficient of the toner without scattering between lots, the optimum processing completion time may be decided while monitoring the property of the toner particles (colored particles) in the course of the process for preparing (polymerizing) the resin particles (polymerized particle) constituting the toner particles, fusing the resin particles, and controlling the shape thereof.

The "monitoring" means to control the processing condition according to the measuring results obtained by a shape measuring means built in the line of the process. For example, in the polymerization toner formed by associating or fusing the resin particles in an aqueous medium, the shape and the diameter of the resin particles are measured while successively sampling and the reaction is stopped at the time when the desired shape is attained. The method for monitoring is not specifically limited; a flow type particle image analyzing apparatus FPIA-2000 (Toa Iyou Denshi Co., Ltd.) can be employed.

This apparatus is suitable since the shape of the particle can be monitored by performing image processing on real time while passing the sample liquid. Namely the sample is continuously monitored by sampling from the reaction place by a pump, and the reaction is stopped at the time when the desired shape is obtained.

(Number Variation Coefficient of the Toner)

The number particle diameter distribution and the number variation coefficient are measured by Coulter Counter TA-II or Coulter Multisizer, manufactured by Coulter Beckman Co., Ltd.

In the invention, Coulter Multisizer was used, which is connected to a personal computer through an interface for outputting the size distribution (manufactured by Nikkaki Co., Ltd.). A 100 μm aperture was used in the Coulter Multisizer and the volume and the number of toner particles of not less than 2 μm were measured and the particle diameter distribution and the average particle diameter were calculated. In the invention, the number average particle diameter distribution is a relative frequency of the particle diameter of the toner particles, and the number average particle diameter is a median diameter in the number particle diameter distribution. The "number variation coefficient of the number particle diameter distribution" of the toner is calculated according to the following expression.

$$\text{Number variation coefficient (\%)}=(S_2/D_n)\times 100$$

In the above expression, $S_2$ is the standard deviation of the number particle diameter distribution and $D_n$ is the number average particle diameter (μm).

The number variation coefficient of the toner particles constituting the toner for developing electrostatic images is preferably not more than 27% and more preferably not more than 25%.

The reason of making the number variation coefficient to not more than 27% is, the same as in the variation coefficient of the shape coefficient, to make the sharp distribution of the electrical charging amount and to raise the transfer efficiency for improving the image quality.

The method for controlling the number variation coefficient of the toner is not specifically limited; for example, a method of classifying in a liquid is effective to make the number variation coefficient to smaller even though a method for classifying the toner particles by blowing is also applicable. For classifying in the liquid, a method using a centrifuge machine is applicable, in which the toner particles are separated and recovered according to the difference of the precipitation rate caused by the difference of the particle diameter of the toner by controlling the rotation speed.

When the toner is produced by a suspension polymerization method, a classifying procedure is essential for making the number variation coefficient to not more than 27%. In the suspension polymerization method, it is necessary to disperse the polymerizable monomer into oil droplets having a desired size as the toner in an aqueous medium. Namely, large oil droplets of the polymerizable monomer are subdivided into droplets having a size near the toner particle by repeatedly mechanical shearing by a homomixer or a homogenizer. By such the mechanical shearing method, the resulted number particle diameter distribution is made wide, accordingly the particle diameter distribution of the toner particles formed by polymerization of such the oil droplets is also made wide. Therefore, the classification process is essential.

(Particle Diameter Distribution of the Toner Particles)

The toner in which the sum (M) is not more than 70% is preferable; the sum (M) is the sum of the relative frequency (m1) of the toner particles included in the class of highest frequency and that (m2) of the toner particles included in the class of secondary higher frequency in a histogram showing the particle diameter distribution based on number in which the natural logarithm lnD, D is particle diameter of toner particle in μm, is taken on the horizontal axis which is measured by plural classes at an interval of 0.23.

When the sum (M) of the relative frequency (m1) and the (m2) is not less than 70%, the occurrence of the selective development is certainly prevented by the use of such the toner in the image formation process since the width of the particle diameter distribution of the toner becomes narrow.

In the histogram showing the particle diameter distribution based on number, the natural logarithm lnD (D is diameter of individual toner particle) is separated into plural classes at the interval of 0.23 (0 to 23:0.23 to 0.46:0.46 to 0.69:0.69 to 0.92:0.92 to 1.15:1.15 to 1.38:1.38 to 1.61:1.61 to 1.84:1.84 to 2.07:2.07 to 2.30:2.30 to 2.53:2.53 to 2.76 . . . ). The histogram is prepared by data of particle diameter measured by Coulter Multisizer under the following conditions are transferred to an computer through an I/O unit and processed in the computer according to a particle diameter distribution analyzing program.

(1) Aperture: 100 μm (2) Sample preparation method: A suitable amount of a surfactant (neutral detergent) is added and stirred to 50 ml to 100 ml of an electrolytic solution Isoton R-11 (manufactured by Coulter-Scientific Japan Co., Ltd.) and 10 mg to 20 mg of the sample to be measured was added to the resultant solution. The system is subjected to a dispersing treatment for 1 minute by an ultrasonic dispersing apparatus.

(Particle Diameter Distribution of the Toner Particle)

The particle diameter distribution of the toner particle is described below.

The particle diameter distribution of the toner particle is preferably monodispersion or near monodispersion; and the ratio of 50%-volume particle diameter (Dv 50: a median diameter in the volume based particle diameter distribution) to 50%-number particle diameter distribution (Dp 50: a median diameter in the number based particle diameter distribution) (Dv 50/Dp 50) is preferably from 1.0 to 1.15, and more preferably from 1.0 to 1.13. It is preferable that the ratio (Dv 75/Dp 75) of the accumulative 75%-volume particle diameter from the large size (Dv 75) to the accumulative 75%-number particle diameter (Dp 75%) is from 1.0 to 1.20 to reduce the presence ratio of the small particle component for preventing the increasing of a weak electrical charging component, the occurrence of reversal polar charging toner, and excessive electrical charging component so as to improve the transferring ability and the cleaning ability of the toner and to obtain an image having high sharpness.

The content of the toner particle having a diameter of not more than 0.7×(Dp 75) is not more than 10% in number for reducing the presence ratio of the small particle diameter component and obtaining an image having high sharpness.

In the invention, a latent image formed on a photoreceptor is developed by the developer having the foregoing particle distribution properties and the developed toner image is transferred onto an intermediate transfer member and the image is further transferred from the intermediate transfer member to a recording material and fixed; in thus obtained image, image defects such as density lowering at the interior portion of a solid image and scattering of the character images are inhibited and the cleaning property of the photoreceptor and the intermediate transfer member can be improved.

The 50%-volume particle diameter (Dv 50) is preferably from 2 μm to 8 μm, and more preferably from 3 μm to 7 μm. By making the (Dv 50) to be within such the range, the resolving power can be further raised, and the amount of the fine toner particle can be reduced, even though the toner is a toner having small particle diameter, so that the cleaning ability and the transfer ratio of the toner are improved for a long period and the image with high sharpness can be stably formed for a long time.

The accumulative 75%-volume particle diameter (Dv 75) and the accumulative 75%-number particle diameter (Dp 75) from larger side are each the volume particle diameter and number particle diameter at the portion of the particle diameter distribution where the accumulation of the frequency from the larger particle diameter side is attained to 75% of the sum of the entire volume of the sum of the entire number, respectively.

The 50%-volume particle diameter (Dv 50), 50%-number particle diameter (Dp 50), 75%-volume particle diameter (Dv 75) and 75%-number particle diameter (Dp 75) can be measured by Coulter Counter TA-II or Coulter Multisizer, manufactured by Coulter Beckman Co., Ltd.

The content of the toner particle of not more than 0.7×(Dp 50) in the toner is not more than 10% in number, and the amount of such the fine particle toner can be measured by an electrophoretic light scattering photometer ELS-800, manufactured by Ootsuka Denshi Co., Ltd.

<<Toner Particle without Corner>>

As to the shape of the toner particle, a toner particle without corner is preferably employed.

The "toner particle without corner" is described referring FIG. 1.

The ratio of the toner particle without corner in the toner particles constituting the toner is preferably not less than 50% in number, and more preferably not less than 70% in number.

When the ratio of the toner particle without corner is not less than 50% in number, spaces in the transferred toner layer (powder layer) are reduced so as to improve the fixing ability and the occurrence of offset becomes difficult. Moreover, toner particles easily abraded or broken and that having portion where electrical charge is concentrated are reduced so that the electrical charging amount distribution becomes sharp and the electrical charging ability is stabilized, and high image quality can be formed for a long period.

The "particle without corner" is a toner particle substantially not has a projected portion where electrical charge is concentrated and a projected portion which is easily abraded by stress, and in concrete, the following particle is defined as the particle without corner. A toner particle, from which a circle C is not substantially projected out is defined as the particle without corner, when a circle C having a radius of L/10, L is the major diameter of the toner particle, is rolled on inside the particle T so as to touch at one point with the out line of the particle. The terms of "substantially not projected out" mean that the number of the projection, where the circle C is projected out, is not more than one. The terms of the "major diameter of toner particle" mean that the width of a toner particle when the distance of two parallel lines each tangent to both sides the projection image of the toner particle on a plane is made largest. FIGS. 1(*b*) and 1(*c*) each show projection images of toner particles having corners.

The measurement of the ratio of the particle without corner is carried out as follows. A magnified photograph is taken by a scanning electron microscope, and the photograph is further enlarged to obtain a photographic image having a magnitude of 15,000. The presence of the corner is determined as to the photographic image. The measurement is carried out with respect to 100 particles.

The method for obtaining the particle without corner is not specifically limited. For example, such the particle can be obtained by the foregoing methods described as the method for controlling the shape coefficient such as the method in which the toner particles are sprayed in a hot gas stream, the method in which mechanical energy by impact force is repeatedly applied to the toner particles in a gas phase, or the method in which the toner particles are added into a solvent capable of not dissolving the toner particle and circled.

<<Production Processes of the Toner for Developing Electrostatic Images>>

The production processes of the toner for developing electrostatic images are described below.

The toner is preferably produced by processes in which composite resin particles are formed in no presence of any colorant and a dispersion of a colorant is added to the dispersion of the composite resin particles, and the composite particles and the colorant particles are salted out, coagulated and fused.

As described above, the polymerization reaction is not hindered by performing the preparation of the composite resin particle in the phase containing no colorant. Therefore, the excellent anti-offset property of the toner is riot degraded and the contamination of the fixing device and the image caused by the accumulation of the toner can be effectively prevented.

No Monomer or oligomer remains in the obtained toner particle as a result of that the polymerization reaction for obtaining the composite resin particle is certainly carried out. Consequently, occurrence of bad order in the thermal fixing process can be prevented or reduced in the image forming method using such the toner.

Moreover, images excellent in the sharpness can be formed for long period since the surface properties of thus obtained toner particles are uniform and the distribution of the electrical charge is sharp.

The composite resin particle is a multi-layered structure resin particle in which one or two or more layers of resin different in the molecular weight and/or composition of the resin from each other are formed on a core particle of resin so as to cover the core particle.

The "central portion (core)" of the composite resin particle is the "core particle" constituting the composite particle.

The "outer layer (shell)" of the composite resin particle is the outermost layer of the one or two or more covering layers constituting the composite resin particle.

The "intermediate layer" of the composite resin particle is the covering layer formed between the central portion (core) and the outer layer (shell).

In the invention, it is preferable to apply a multi-step polymerization method to obtain the composite rein particle from the viewpoint of controlling the molecular weight distribution for securing the anti-offset property. The multi-step polymerization method is a method in which a monomer (n+1) is polymerized (the $n^{th}$+1 step) in the presence of resin particle (n) produced by polymerization (the $n^{th}$ step) of a monomer (n) so that a covering layer (n+1) composed of polymer of the monomer (n+1) (different from the resin particle (n) in the dispersing state and/or composition) is formed on the surface of the resin particle (n).

When the resin particle (n) is the core particle (n=1), the polymerization method is a "two-step polymerization method", and when the resin particle (n) is a composite resin particle ($n \geqq 2$), the method becomes a "three- or more-step polymerization method".

In the composite rein particle obtained by the multi-step polymerization method, plural kinds of resins different from each other in the composition and/or molecular weight are contained. Accordingly, the toner obtained by salting out, coagulating and fusing the composite resin particles and the colorant particles is characterized that the scattering of the composition, molecular weight and surface properties between the individual toner particles is very small.

The anti-offset ability and the anti-winding ability can be improved and an image having suitable glossiness can be obtained while maintaining high adhesiveness (high fixing strength) to the image supporting material in the image forming method including the fixing process by a contact heating method by the use of such the toner uniform in the composition, molecular weight and surface properties.

A concrete example of the production method of the toner for developing electrostatic images is described below.

The production method is constituted by the following processes:

(1) A poly-step polymerization process (I) for obtaining a composite resin particle which is prepared so that a parting agent and/or crystalline polyester are contained in the area other than the outermost layer (in the central portion or intermediate layer)

(2) A salting out, coagulating and fusing process (II) for salting out, coagulating and fusing the composite resin particles and colorant particles for obtaining toner particles (3) A filtration and washing process for separating the toner particles from the dispersion system by filtration and removing a surfactant from the toner particle (4) A drying process for drying the washed toner particles, and (5) A process for adding an external additive to the dried toner particles Each of the processes is described below.

<<Multi-Step Polymerization Process (I)>>

The multi-step polymerization process (I) is the process for producing the composite resin particles by a multi-step polymerization process in which the covering layer (n+1) composed of the monomer (n+1) is formed on the resin particle (n). A three- or more-step polymerization is preferably employed from the viewpoint of the stability of the production and the crushing strength of the obtained toner.

The two-step and three-step polymerization methods are described below as the typical examples of the multi-step polymerization method.

<<Description of the Two-Step Polymerization Method>>

The two-step polymerization method is a method for producing a composite resin particle composed of a central portion (core) constituted by a high-molecular weight resin containing the parting agent and a outer layer (shell) constituted by a low molecular weight resin. Namely, the composite rein particle by such the two-step polymerization method is constituted by the core and one covering layer.

The method is concretely described below. First, a monomer solution, in which the parting agent is dissolved, is dispersed in an aqueous medium (an aqueous solution of a surfactant) into a form of oil droplets, and then the system is polymerized (the first polymerization step) to prepare high molecular weight resin particles containing the parting agent.

Thereafter, a polymerization initiator and a monomer (L) for obtaining a low molecular weight resin are added to the resultant resin particle dispersion, and the polymerization treatment (the second polymerization step) is performed in the presence of the resin particle so as to form a covering layer of a low molecular weight resin (polymer of the monomer) on the resin particle surface.

<<Description of the Three-Step Polymerization Method>>

The three-step. polymerization method is a method for producing a composite resin particle composed of a central portion (core) constituted by a high-molecular weight resin, an intermediate layer containing the parting agent and a outer layer (shell) constituted by a low molecular weight resin. Namely, the composite rein particle by such the three-step polymerization method is constituted by the core and two covering layers.

The method is concretely described below. First, a dispersion of resin particles obtained by a usual polymerization treatment (the first polymerization step) is added to an aqueous medium (an aqueous solution of a surfactant), and a monomer solution, in which the parting agent is dissolved, is dispersed into oil droplets and the system is subjected to a polymerization treatment (the second polymerization step) so as to from a dispersion of composite resin particle [high molecular weight resin-intermediate molecular weight resin] constituted by a covering layer composed of resin (polymer of the monomer) containing the parting agent formed on the surface of the resin particle (core particle).

Thereafter, a polymerization initiator and a monomer for obtaining a low molecular weight resin are added to the resultant resin particle dispersion, and the polymerization treatment (the third polymerization step) is performed in the presence of the composite resin particle so as to form a covering layer of a low molecular weight resin (polymer of the monomer) on the composite resin particle surface.

In the three-step polymerization method, on the occasion of the formation of the covering layer on the surface of the resin particle, the parting agent can be finely and uniformly dispersed by a method in which the dispersion of the resin particles is added to the aqueous medium and the monomer solution, in which the parting agent is dissolved, is dispersed into the oil droplets in the aqueous medium and the resultant system is subjected to the polymerization treatment (the second polymerization step).

The addition of the resin particle dispersion and the oil droplet dispersing of the monomer solution may be either performed previously as follows and simultaneously. The method included the following embodiments.

(a) An embodiment in which the resin particles to be the central portion (core) are added to the aqueous solution of the surfactant on the occasion of the formation of the intermediate layer constituting the composite resin particle, and then the monomer composition containing the parting agent and the crystalline polyester is dispersed in the aqueous solution, and the system is subjected to a polymerization treatment.

(b) An embodiment in which the monomer composition containing the parting agent and the crystalline polyester is dispersed in the surfactant aqueous solution on the occasion of the formation of the intermediate layer constituting the composite resin particle, and then the resin particles to be the central portion (core) are added, and the system is subjected to a polymerization treatment.

(c) An embodiment in which the resin particles to be the central portion (core) are added to the aqueous solution of the surfactant on the occasion of the formation of the intermediate layer constituting the composite resin particle, and the monomer composition containing the parting agent and the crystalline polyester is simultaneously dispersed in the aqueous solution, and the system is subjected to a polymerization treatment.

For forming the resin particle (core particle) or the covering layer (intermediate layer), a method can be applied in which the parting agent is dissolved in the monomer, and the resultant monomer solution is dispersed in an aqueous medium as the oil droplets and the system is subjected to the polymerization treatment to obtain latex particles.

The "aqueous medium" is a medium composed of 50 to 100% by weight of water and 0 to 50% by weight of a water-soluble organic solvent. Examples of the water-soluble solvent include methanol, ethanol, iso-propahol, butanol, acetone, methyl ethyl ketone and tetrahydrofuran; and an alcoholic organic solvent capable of not dissolve the resin is preferable.

As the method suitable for forming the resin particle or the covering layer each containing the parting agent, a method is applicable in which the monomer solution in which the parting agent is dissolved is dispersed by utilizing mechanical energy into oil droplet form in the aqueous medium containing the surfactant in a concentration less than the critical micelle concentration to form a dispersion, and a water-soluble polymerization initiator is added to the resultant dispersion and the monomer is polymerized by radical polymerization in each of the droplets (hereinafter such the method is referred to as a mini-emulsion method). An oil-soluble polymerization initiator may be used in the monomer solution together with the water-soluble polymerization initiator, instead of the addition of the water-soluble polymerization initiator.

By the mini-emulsion method mechanically forming the oil droplets, the parting agent dissolved in the oil phase is not released so that sufficient amount of the parting agent can be introduced into the formed resin particle or the covering layer.

The dispersing machine for oil droplet dispersing by the mechanical dispersion is not specifically limited. A stirring machine CLEARMIX having a high speed rotor, manufactured by M•Technic Co., Ltd., an ultrasonic disperser, a mechanical homogenizer, Manton-Gaulin homogenizer and a pressing type homogenizer are applicable. The dispersed particle diameter is from 10 nm to 1,000 nm, preferably from 50 nm to 1,000 nm, and more preferably from 30 nm to 300 nm.

An emulsion polymerization method, a suspension polymerization method and a seed polymerization method are applicable as the polymerization method for forming the resin particle or covering layer each containing the parting agent. These polymerization methods are also applicable for forming the composite resin particle or covering layer each containing neither parting agent nor crystalline polyester.

The diameter of the composite resin particle obtained by the polymerization process (I) is preferably within the range of from 10 nm to 1,000 nm in the weight average particle diameter measured by electrophoretic light scattering photometer ELS-800, manufactured by Ootsuka Denshi Co., Ltd.

The glass transition point (Tg) of the composite resin particle is preferably within the range of from 48° C. to 74° C., and more preferably from 52° C. to 64° C. The softening point of the composite resin particle is preferably within the range of from 95° C. to 140° C.

<<Salt Out, Coagulation and Fusion Process (II)>>

The salt out, coagulation and fusion process (II) is a process in which irregular-shaped (non-spherical) toner particles are obtained by salting out, coagulating and fusing (the salt out and the fusion are simultaneously performed) the composite resin particles and the colorant particles.

In the salt out, coagulation and fusion process (II), an internal additive particles (fine particles having a number average primary particle diameter of approximately 10 nm to 1,000 nm) such as a charging controlling agent may be salted out, coagulated and fused together with the composite resin particles and the colorant particles.

The colorant particle may be modified on its surface. Known surface modifying agents are usable.

The colorant particles are subjected to the salting out, coagulating and fusing treatment in a state of dispersed in an aqueous medium. An aqueous solution dissolving a surfactant in a concentration higher than the critical micelle concentration is employable as the aqueous medium in which the colorant particles are dispersed.

A surfactant the same as that employed in the multi-step polymerization can be employed as the above surfactant.

A dispersing machine CLEARMIX having a high speed rotor, manufactured by M•Technic Co., Ltd., an ultrasonic disperser, a mechanical homogenizer, a pressing dispersing machine such as Manton-Gaulin homogenizer and a pressing type homogenizer, and a medium type dispersing machine such as Getzman mill and a diamond fine mill are applicable, even though the dispersing machine to be employed for dispersing the colorant particles is not specifically limited.

For salting out, coagulating and fusing the composite resin particles and the colorant particles, it is preferable that a coagulation agent in a concentration higher than the critical coagulation concentration is added to dispersion in which the composite resin particles and the colorant particles are dispersed and the dispersion is heated by a temperature higher than the glass transition point (Tg) of the composite resin particle.

It is more preferably to employ a coagulation stopping agent when the diameter of the composite resin is attained to the designated particle. A mono-valent metal salt, particularly sodium chloride, is preferable as the coagulation stopping agent.

The temperature range suitable for performing the salt out, coagulation and fusion is from (Tg+10° C.) to (Tg+50° C.), particularly preferably from (Tg+15° C.) to (Tg+40° C.). A water permissible organic solvent may be added for effectively performing the fusion.

The fore going alkali metal salts and alkali-earth metal salts are employable for the coagulation agent to be employed on the occasion of the salt out, coagulation and fusion.

The salt out and the coagulation applied in the invention is described below.

The "salt out, coagulation and fusion" in the invention is fact that the salt out (coagulation of particles) and the fusion (disappearance of the interface between the particles) are simultaneously progress or an action for raising such the phenomenon.

It is preferable for simultaneously perform the slat out and fusion that the coagulation of the particles (the composite resin particles and the colorant particles) is carried out at a temperature higher than the glass transition point (Tg) of the resin constituting the composite resin particles.

The toner for developing electrostatic images is preferably prepared by forming the composite resin particle in the presence of no colorant and adding dispersion of the colorant particles to the dispersion of the composite resin particles, and then salting out, coagulating and fusing the composite resin particles and the colorant particles.

As above-mentioned, the polymerization reaction is not hindered by performing the preparation of the composite resin particle in the system containing no colorant. Therefore, the excellent anti-offset property of the toner is not degraded and the contamination of the fixing device and the image caused by the accumulation of the toner can be effectively prevented.

No Monomer or oligomet remains in the obtained toner particle as a result of that the polymerization reaction for obtaining the composite resin particle is certainly carried out. Consequently, bad order does not occur in the thermal fixing process using such the toner.

The surface properties of the obtained toner particles are uniform and the distribution of the electrical charging amount is sharp, therefore images excellent in the sharpness can be formed for a long period. The anti-offset ability and the anti-winding ability can be improved and an image having suitable glossiness can be obtained while maintaining high adhesiveness (high fixing strength) to the image supporting material in the image forming method including the fixing process by a contact heating method by the use of such the toner uniform in the composition, molecular weight and surface properties.

<<Parting Agent>>

The parting agent to be employed in the toner is described below.

The content of the parting agent in the toner is usually from 1% to 30% by weight, preferably from 2% to 20% by weight, and more preferably from 3%. to 15% by weight.

As the parting agent, low molecular weight polypropylene (average molecular weight=1,500 to 9,000) or low molecular weight polyethylene may be added, and ester type compound represented by the following formula is preferred.

$$R_1—(OCO—R_2)_n \qquad \text{Formula}$$

In the formula, n is an integer of from 1 to 4, preferably from 2 to 4 and more preferably 2 or 3.

$R_1$ and $R_2$ are each a hydrocarbon group which may have a substituent.

In $R_1$, the number of carbon atoms is from 1 to 40, preferably from 1 to 20, and more preferably from 2 to 5, and in $R_2$, the number of carbon atoms is from 1 to 40, preferably from 16 to 30, and more preferably from 18 to 26. Though the concrete examples of the compound represented by the above formula are listed below, the invention is not limited thereto.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

-continued

8)

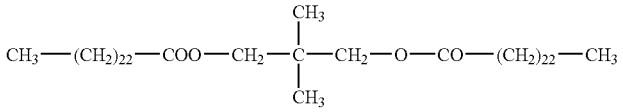

9)

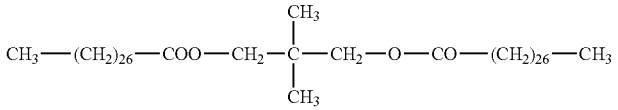

10)

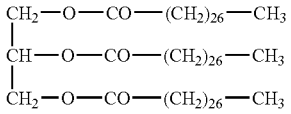

11)

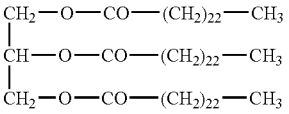

12)

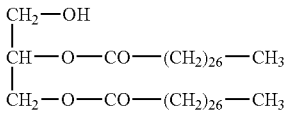

13)

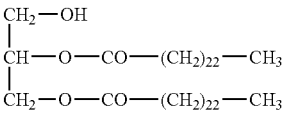

14)

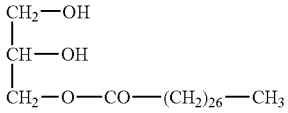

15)

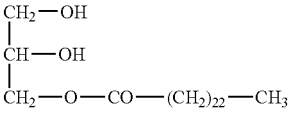

16)

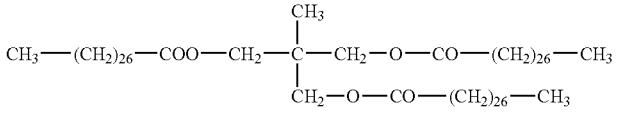

17)

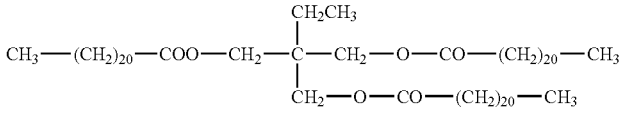

18)

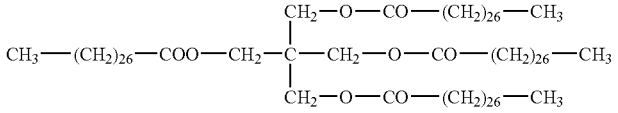

19)

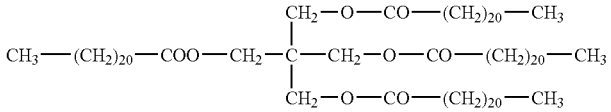

20)

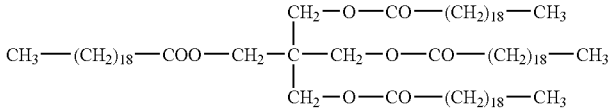

21)

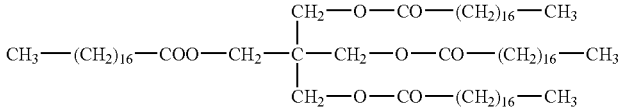

The adding amount of the above-described parting agent and the fixing improving agent represented by the formula is from 1% to 30%, preferably from 2% to 20%, and more preferably from 3% to 15%, by weight of the whole toner for developing electrostatic images.

Preferable molecular weight, range of the molecular weight and peak molecular weight of the resin component constituting the toner are described below.

It is preferable that the toner has a peak or shoulder at 100,000 to 1,000,000 and 1,000 and 50,000.

The resin of the toner preferably contains a high molecular weight component having a peak or shoulder in the range of from 100,000 to 1,000,000 and a low molecular weight component having a peak or shoulder in the range of from 1,000 to 50,000.

The above molecular weight is measured by GPC (gel permeation chromatography) using THF (tetrahydrofuran).

In concrete, 1 ml of THF is added to 1 mg of the sample and stirred by a magnetic stirrer at a room temperature to sufficiently dissolve. The solution is treated by a membrane filter having a pore size of from 0.45 to 0.50 μm and injected into the GPC. For the measuring by the GPC, the column is stabilized at 40° C. and THF is passed in a rate of 1 ml per minute and 100 μm of the sample in a concentration of 1 mg/ml is injected. A combination of polystyrene columns available on the market is preferably employed. For example, a combination of Shodex KF-801, 802, 803, 804, 805, 806 and 807, each manufactured by Showa Denko Co., Ltd., and a combination of TSK gel G-1000H, G2000H, G3000H, G4000H, G5000H, G7000H and guard column, manufactured by Toso Co., Ltd., are employable.

A refraction detector (IR detector) or a UV detector is preferably employed as the detector. The molecular weight of the sample is calculated according to a calibration curve prepared by using monodispersed polyethylene standard particles. About ten kinds of the polystyrene are preferably employed for preparing the calibration curve.

The filtration and washing process is described below.

In the filtration and washing process, a filtration treatment for separation the toner particles from the dispersion by filtration, and a washing treatment for removing the adhering substance such as the surfactant and the coagulating agent for the filtered toner particles (a cake-shaped mass) are performed.

For the filtration treatment, a centrifugal separation method, a pressure reduction filtration method using a Nutsche funnel and a filter press are applicable without any limitation.

<<Drying Process>>

This process is a process for drying the washed toner particles.

In this process, a spray dryer, a vacuum freezing dryer, and a pressured reduction dryer are usable, and a standing rack dryer, a moving rack dryer, a fluid bed dryer, a rotary dryer and a stirring dryer are preferably employed.

The moisture content of the dried toner particles is preferably not more than 5% by weight, and more preferably not more than 2% by weight.

When the dried toner particles are coagulated by weak inter particle attracting force, the coagulated mass may be broken. A mechanical crushing apparatus such as a jet mill, a Henschel mixer, a coffee mill and a food processor can be applied as the breaking apparatus.

The polymerizable monomer is described below.

(1) Hydrophobic Monomer

Known monomers can be employed for the hydrophobic monomer constituting the monomer composition without any limitation. One or a combination of two or more kinds of the monomer may be employed to satisfy required properties.

In concrete, mono-vinyl aromatic type monomers, (meth) acrylate type monomers, vinyl ester type monomers, vinyl ether type monomers, mono-olefin type monomers, di-olefin type monomers and halogenized olefin type monomers are employable.

Examples of the vinyl aromatic monomer include a styrene monomer such as styrene, o-methyl styrene, m-methyl styrene, p-methyl styrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene, and a derivative thereof.

Examples of the acryl type monomer include acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate and diethylaminoethyl methacrylate.

Examples of the vinyl ester monomer include vinyl acetate, vinyl propionate and vinyl benzoate.

Examples of the-vinyl ether monomer include vinyl methyl ether, vinyl ethyl ether, vinyl isobutyl ether and vinyl phenyl ether, Examples of the mono-olefin monomer include ethylene, propylene, iso-butylene, 1-butene, 1-pentene and 4-methyl-1-pentene.

Examples of the di-olefin monomer include butadiene, isoprene and chloroprene.

(2) Crosslinkable Monomer

A crosslinkable monomer may be added for improving properties of the resin particle. As the crosslinkable monomer, ones having two or more unsaturated bonds such as divinylbenzene, divinylnaphthalene, divinyl ether, diethylene glycol methacrylate, ethylene glycol dimethacrylate, polyethylene glycol dimethacrylate and diallyl phthalate are employable.

(3) Monomers having an Acidic Polar Group

As a monomer having an acidic polar group, (a) an α,β-ethylenic unsaturated compound having a carboxylic group (—COOH) and (b) an α,β-ethylenic unsaturated compound having a sulfonic acid group (—$SO_3H$) can be exemplified.

Examples of the α,β-ethylenic unsaturated compound having a carboxylic group (—COOH) of (a) include acrylic acid, methacrylic acid, fumalic acid, maleic acid, itaconic acid, cinnamic acid, butyl mono-maleate, octyl mono-maleate and their salt of a metal such as Na or Zn.

Examples of the α,β-ethylenic unsaturated compound having a sulfonic acid group (—$SO_3H$ group) of (b) include sulfonized styrene and its Na salt, allylsuofosuccinic acids octyl allylsulfosuccinate and their Na salt.

The initiator (also called as polymerization initiator) to be used for polymerization of the polymerizable monomer is described below.

The polymerization initiators are optionally usable as long as those are water-soluble. For example, a persulfate such as potassium per sulfate and ammonium per sulfate, an azo compound such as 4,4'-azobis4-cyanovalerianic acid and its salt and 2,2'-azobis(2-amidinopropane), and a peroxide compound such as hydrogen peroxide and benzoylperoxide.

The above polymerization initiators may be used as a redox type initiator by combining with a reducing agent, according necessity. By the use of the redox initiator, the activity of polymerization is raised so as the temperature for the polymerization can be lowered and the shortening of the polymerization time can be expected.

For example, a temperature of from 50° C. to 80° C. applied for the polymerization, even though any temperature can be applied as long as the temperature is higher than the lowest radical generation temperature. The polymerization can be progressed at a room temperature of near room temperature by the use of a room temperature initiator such as a combination of hydrogen peroxide and a reducing agent such as ascorbic acid.

The chain transfer agent is described below.

Usually used known chain transfer agent can be employed for controlling the molecular weight of the resin particle formed by the polymerization of the polymerizable monomer.

Though the chain transfer agent is not specifically limited, a compound having a mercapto group is preferably employed since the toner having a sharp distribution of molecular weight can be obtained, which is excellent in the storage ability, fixing strength and anti-offset ability. For example, the compound having a mercapto group such as octanethiol and tert-dodecanethiol is used.

Preferable examples include ethyl thioglycolate, propyl thioglycolate, butyl thioglycolate, t-butyl thioglycolate, 2-ethylhexyl thioglycolate, octyl thioglycolate, decyl thioglycolate, dodecyl thioglycolate, thioglycolate of ethylene glycol, thioglycolate of neopentyl glycol and thioglycolate of pentaerythrytol.

Among them, n-octyl 3-mercaptopropionate is preferably employed from the viewpoint of inhibition the odor occurrence on the occasion of thermal fixing of the toner.

<<Colorant>>

The colorant is described below.

The colorant relating to each of the yellow, magenta, cyan and black toners for developing electrostatic images is preferably contained in the toner particle together with the composite resin particle by salting out, coagulation and fusing on the occasion of the process of the toner production.

As the colorant (the colorant particles salted out, coagulated and fused together with the composite resin particles), various inorganic pigments, organic pigments and dyes are employable. Known black pigments and magnetic powders are use as the inorganic colorant.

Examples of the black pigment to be employed for preparation of the toner are carbon black such as furnace black, channel black, acetylene black, thermal black and lump black, and a magnetic powder such as magnetite and ferrite.

These inorganic pigments can be employed singly or in a combination of plural kinds thereof. The content of the inorganic pigment is preferably from 2% to 20% by weight, and more preferably from 3% to 15% by weight.

When the toner is employed as a magnetic toner, the magnetite can be added. In such the case, the content of it in the toner is preferably from 20% to 120% by weight for providing desired magnetic properties.

Know organic pigments and dyes are also usable. Concrete examples of the organic pigment and dye are listed below.

Examples of the magenta of red organic pigments for preparation of the magenta toner include C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178 and C. I. Pigment Red 222.

Examples of orange or yellow pigment for preparation of the yellow toner include C. I. Pigment orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 93, C. I. Pigment Yellow 94, C. I. Pigment Yellow 138, C. I. Pigment Yellow 180, C. I. Pigment Yellow 185, C. I. Pigment Yellow 155 and C. I. Pigment Yellow 156.

Examples of green or cyan pigment for preparation of the cyan toner include C. I. Pigment Blue 15, C. I. Pigment Blue 15:2, C. I. Pigment Blue 15:3, C. I. Pigment Blue 16, C. I. Pigment Blue 60 and C. I. Pigment Green 7.

Examples of dye include C. I. Solvent Red 1, 49, 52, 58, 63, 111 and 122, C. I. Solvent Yellow 19, 44, 77, 79, 81, 93, 98, 103, 104, 112 and 162, and Solvent Blue 25, 36, 60, 70, 93, and 95.

These organic pigments and dyes can be employed singly or in a combination of plural kinds thereof. The content of the organic pigment or dye is preferably from 2% to 20% by weight, and more preferably from 3% to 15% by weight.

The colorant (colorant particle). may be modified on the surface thereof.

For the surface modifying agent, known ones, concretely a silane coupling agent, titanium coupling agent and aluminum coupling agent, can be employed.

Examples of the silane coupling agent include an alkoxysilane such as methyltrimetoxysilane, phenyltrimethoxysilane, methylphenyldimethoxysilane and diphenyldimethoxy silane, a siloxane such as hexamethyldisiloxane, and γ-chloropropyltrimethoxysilane, vinyltrichlorosilane, vinyltrimethoxysilane, vinyltriethoxysilane, γ-methacryloxypropyltrimethoxysilane, γ-gylcidoxypropyltrimethoxysilane, γ-mercaptopropyltrimethoxsilane, γ-aminopropyltriethoxysilane andγ-ureidopropyltriethoxysilane.

Examples of the titanium coupling agent include TTS, 9S, 38, 41B, 46B, 55, 138S and 238S marketed by Ajinomoto Co., Ltd., under the commercial name of Plenact, and A-1, B-1, TOT, TST, TAA, TAT, TLA, TOG, TBSTA, A-10, TBT, B-2, B-4, B-7, B-10, TBSTA-400, TTS, TOA-30, TSDMA, TTAB and TTOP marketed by Nihon Soda Co., Ltd.

Examples of the aluminum coupling agent include PLENACT AL-M.

The adding amount of the surface modifying agent is preferably from 0.01% to 20% by weight, and more preferably from 0.1% to 5% by weight, of the colorant.

The surface modifying can be performed by adding the surface modifying agent to colorant particle dispersion and reacting by heating the resultant system.

The surface modified colorant particles are recovered by filtration and repeatedly subjected to washing and filtering treatments, and then dried.

<<Internal Additive>>

An internal additive other than the parting agent such as an electrical charge controlling agent may be contained in the toner particle constituting the toner.

As the electrical charge controlling agent to be contained in the toner particle, a nigrosin type dye, a metal salt of naphthenic acid or a higher fatty acid, an alkoxylized amine, a quaternary ammonium chloride, an azo-metal complex, and a metal salt or metal complex of salicylic acid are usable.

<<Developer>>

The developer is described below.]

The toner may either be used as a single-component developer or a double-component developer.

In the case of the single-component developer, both of a non-magnetic single-component developer and a magnetic single-component developer in which the toner contains the magnetic particles of about 0.1 μm to 0.5 μm are usable.

The toner can be used as a double-component developer by mixing with carrier. In such the case, known material, for example, a metal iron, ferrite, magnetite and an alloy such as that of aluminum or lead with the above metals are usable as the magnetic particle of the carrier. The ferrite particle is particularly preferred. The volume average particle diameter (D4) is preferably from 15 μm to 100 μm, and more preferably from 25 μm to 80 μm.

The volume average diameter of the carrier can be measured by a laser diffraction type particle size distribution measuring apparatus HELOS, manufactured by Sympatec Co., Ltd., having a wet dispersing machine.

Carrier composed of magnetic particles coated with resin and resin dispersion type carrier in which the magnetic particles are dispersed in resin are preferred. Though the composition of the resin for coating is not specifically limited, for example, an olefin type resin, a styrene type resin, a styrene-acryl type resin, a silicone type resin, an ester type resin and a fluorine-containing polymer type resin are employable. Known resins for constituting the resin dispersion carrier are employed without any limitation, for example, a styrene-acryl type resin, a polyester resin, a fluororesin and a phenol resin can be employed.

<<Photoreceptor>>

The photoreceptor is described below.

In the invention, the photoreceptor is an electrophotographic photoreceptor; and the effect of the invention is considerably enhanced when an organic electrophotographic photoreceptor (organic photoreceptor) is employed. The organic photoreceptor is an electrophotographic photoreceptor in which at least on of the charge generation function and the charge transfer function essential for constituting the photoreceptor is allotted by an organic compound, and the invention entirely includes a photoreceptor constituted by a known organic charge generation material or a known organic charge transfer material and a photoreceptor in which the charge generation function and the charge transfer function are allotted by a polymer complex.

The constitution of the organic photoreceptor employed in the invention is described below.

<<Electroconductive Substrate>>

Though either a sheet-shaped or a cylindrical substrate may be employed, the cylindrical electroconductive substrate is preferable for designing a compact image forming apparatus.

The cylindrical electroconductive substrate is a cylindrical substrate necessary for endlessly forming images by rotation thereof, and an electroconductive substrate having a true circular degree of not more than 0.1 mm and a swinging degree of not more than 0.1 mm is preferable. When the true circular degree and the swinging degree exceed such the range, the suitable image formation becomes difficult.

A drum of metal such as aluminum and nickel, a plastic drum vapor deposited with aluminum, tin oxide or indium oxide, and a paper or plastic drum coated with an electroconductive substance are employable. The electroconductive substrate having a specific resistance of not more than $10^3$ Ωcm is preferable.

<<Intermediate Layer>>

An intermediate layer having functions of improving the adhesiveness with the photosensitive layer and an electrical barrier may be provided between the electroconductive substrate and the photosensitive layer. The thickness of the intermediate layer using hardenable metal resin is preferably from 0.1 μm to 5 μm.

<<Photosensitive Layer>>

The photosensitive layer of the photoreceptor preferably has a constitution in which the function of the photosensitive layer is separated into a charge generation layer (CGL) and a charge transfer layer (CTL), even though a single photosensitive layer structure is allowed, in which one layer having the charge generation function and the charge transfer function is provided on the intermediate layer. Increasing of the remaining potential accompanied with the repeating use is controlled to small and another property can be easily controlled so as to suite the object by the function separated structure. It is preferable in a photoreceptor to be negatively charged that the charge generation layer (CGL) is provided on the intermediate layer and the charge transfer layer (CTL) is provided on the CGL. In a photoreceptor to be positively charged, the order of the layer structure is reversed in the negatively charging photoreceptor. The most preferable constitution of the photosensitive layer in the invention is the negatively charging photoreceptor having the function separating structure.

The constitution of the photosensitive layer of the function separated type negatively charging photoreceptor is described below.

<<Charge Generation Layer>>

The charge generation layer contains a charge generating material. The layer may contain a binder resin and another additive according to necessity.

Know charge generation materials (CGM) can be employed for the charge generation material (CGM). For example, a phthalocyanine pigment, an azo pigment, a perylene pigment and an azulenium pigment can be employed. Among them, the CGM capable of making to minimize the increasing of the remaining charge accompanied with the repeating use is ones having a steric and electric structure capable of taking a stable coagulated structure, in concrete, a phthalocyanine pigment and a perylene pigment each having a specific crystal structure.

The CGMs such as titanylphthalocyanine showing the maximum peak of Brag angle 2θ of Cu—Kα ray at 27.2° and benzimidazoleperylene showing the maximum peak of Brag angle 2θ at 12.4° are almost not degraded by the repeating use so that the increasing of the remaining electric potential can be inhibited.

When binder is employed in the charge generating layer as the dispersing medium of CGM, known resin can be employed, and examples of the most preferable resin are a formal resin, a butyral resin, a silicone resin, a silicone-modified butyral resin and a phenoxy resin. The ratio of the charge generation material to the binder resin is preferably from 20 to 600 parts by weight to 100 parts by weight of the binder resin. By the use of such the resins, the increasing of the remaining electrical potential accompanied with the repeating use can be made minimum. The thickness of the charge generation layer is preferably from 0.01 μm to 2 μm.

<<Charge Transfer Layer>>

The charge transfer layer contains the charge transfer material (CTM) and a binder for dispersing CTM and forming the film. Other than those, an additive such as an anti-oxidant may be contained according to necessity.

Known charge transfer materials (CTM) can be employed as the charge transfer material (CTM). For example, a triphenylamine compound, a hydrazone compound, a styryl compound, a benzidine compound and a butadiene compound are employable. These charge transfer materials are usually dissolved in a suitable binder resin for film forming. Among then CTM capable of minimizing the electrical charge increasing accompanied with the repeating use is one having a high moving rate and the difference of the ionization potential to that of CGM is not more than 0.5 eV, and preferably not more than 0.25 eV.

The ionization potential of CGM and CTM can be measured by a surface analyzing apparatus AC-1 manufactured by Riken Keiki Co., Ltd.

Examples of the resin employed in the charge transfer layer (CTL) include polystyrene, an acryl resin, a methacryl resin, a vinyl chloride resin, a vinyl acetate resin, a poly(vinyl butyral) resin, an epoxy resin, a polyurethane resin, a phenol resin, a polyester resin, an alkyd resin, a polycarbonate resin, a silicone resin, a melamine resin and a copolymer containing two or more repeating units of the above resins. A high molecular weight organic semiconductor compound such as poly-N-vinylcarbazole is usable in addition to the above isolating resins. Among them, the polycarbonate resin is most preferable for the binder of CTL. The thickness of the charge transfer layer is preferably from 10 to 40 μm.

The thickness of the charge transfer layer is preferably adjusted to from 5 μm to 15 μm, and more preferably from 6

μm to 13 μm, in average for stabilizing the developing ability and the transfer ability of the toner so as to enhance the effects described in the invention by reducing the difference of the dielectric constant on the photoreceptor. The thickness of the charge transfer layer can be measured by a layer thickness measuring apparatus EDDY560C, manufactured by Helmut Fischer GMBTE Co., utilizing eddy current measurement. The thickness of the charge transfer layer is defined by the average of values measured at 10 points randomly selected on the photosensitive layer. The varying range of the layer thickness is preferably not more than 2 μm in the difference between the largest thickness and the smallest thickness.

<<Protective Layer>>

A layer composed of various kinds of resin may be provided as a protective layer of the photoreceptor. Particularly, an organic photoreceptor having high mechanical strength can be obtained by providing a crosslinking resin layer.

Figure 2:
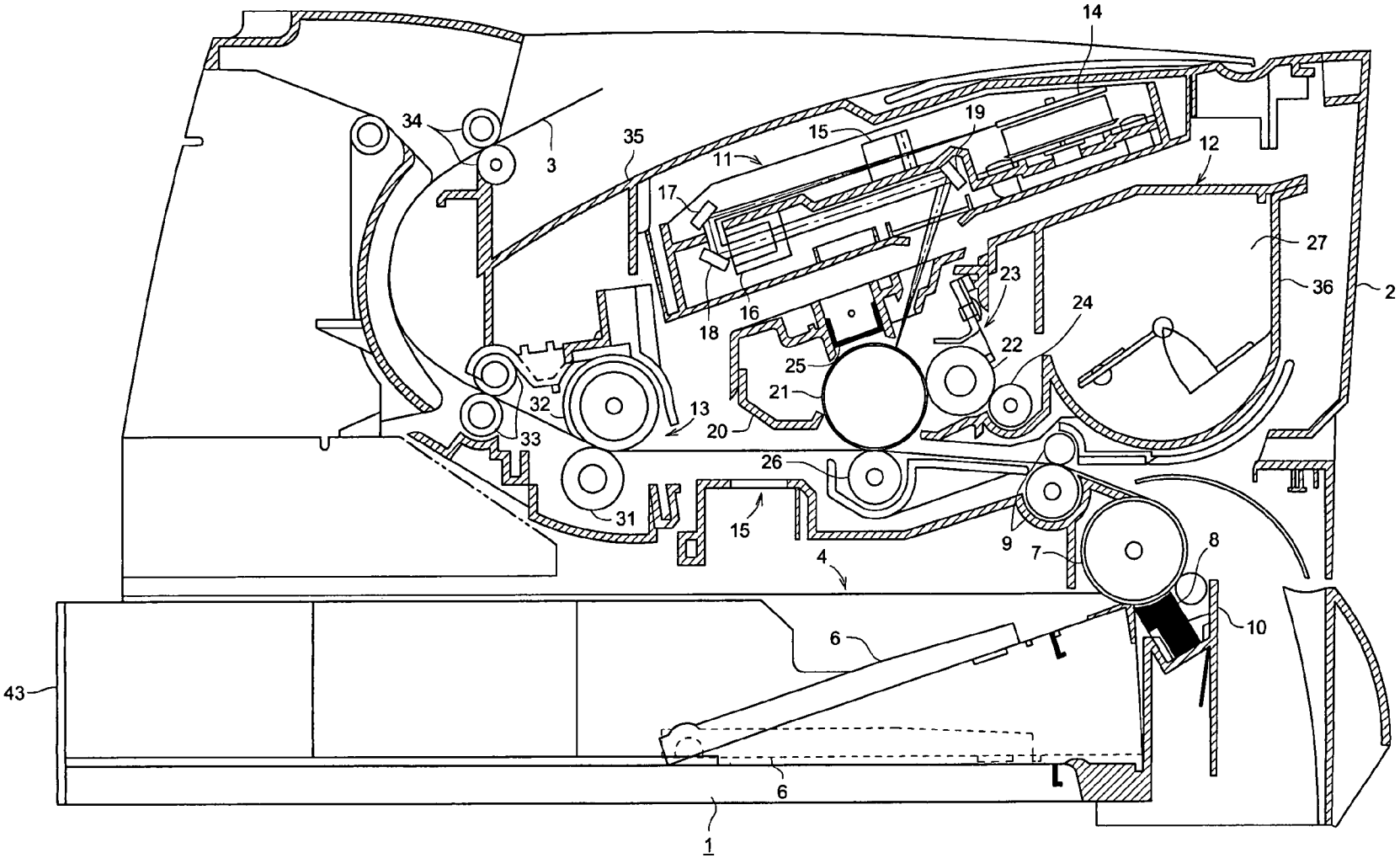
FIG. 2 shows a side cross section of principal portion of a laser printer as an image forming apparatus.

FIG. 2 shows a cross section of principal parts of a laser printer as an embodiment of the image forming apparatus. In The laser printer 1 shown in FIG. 1 has a feeder unit 3 for supplying paper 3 as a recording medium and an image forming unit for forming the designated image on the supplied paper 3 in a casing 2.

The feeder unit 4 has a paper supplying tray 43 capable of releasing and fitting to the bottom of the casing 2, a paper pressing plate 6 provided in the paper supplying tray 43, a paper supplying roller 7 and a paper supplying pad 8 provided upon the one end sided of the paper supplying tray 43, and a resist roller 9 provided at the position of lower reaches of the paper conveying direction.

The paper pressing plate 6, on which paper sheets can be laminatedly stacked, is rotatably supported at the end far from the paper supplying roller 7 and the end near the roller 7 is rotatable in upper and lower direction, and pressed from the back side by a spring not shown in the drawing. Consequently, the paper pressing plate 6 is rotated toward lower direction against the force of the spring on the fulcrum at the end far from the paper supplying roller 7 according to the increasing of the stacked paper amount. The paper supplying roller 7 and the paper supplying pad 8 are arranged so as to face with together and the paper supplying pad 8 is pressed to the paper supplying roller 7 by a spring 10 provided at the back side of the paper supplying pad 8. The paper sheet 3 on the top of the stacked sheets on the paper pressing plate 6 is pressed by a spring, not shown in the drawing, to the paper supplying roller 7, and inserted between the paper supplying roller 7 and the paper supplying pad 8 by the rotation of the paper supplying roller 7 and supplied one by one. The resist roller 9 is composed of a driving roller and a submitting roller, and sends the paper 3 conveyed from the paper supplying roller 7 to the image forming unit after designated resisting.

The image forming unit has a scanning unit as the electrostatic latent image forming means, a developing unit and a fixing unit 13.

The scanning unit 11 is provided at the upper portion of the casing 2, which has a laser light emitting means not shown in the drawing, a rotating polygon mirror 14, lenses 15 and 16, and mirrors 17, 18 and 19. The laser light beam emitted according to designated image from the laser light emitting means data is passed and reflected by the polygon mirror 14, lens 15, mirrors 17 and 18, lens 16 and mirror 19 in this order and irradiated by high speed scanning onto the later-mentioned developing unit 12 and photoreceptor drum 21.

Figure 3:
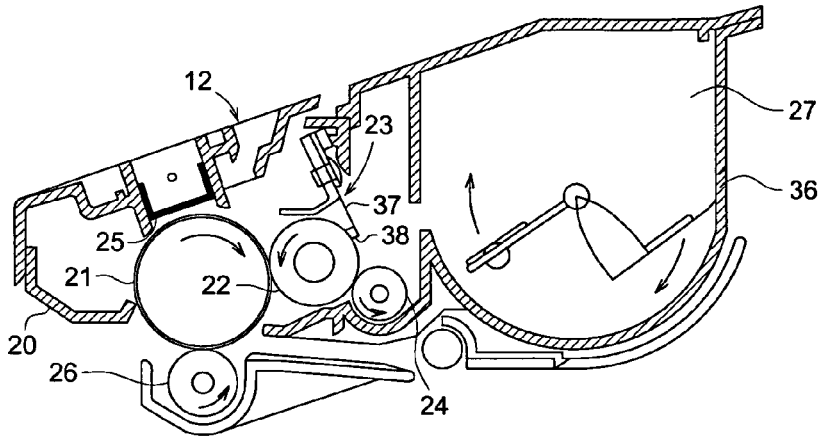
FIG. 3 shows an enlarged side cross section of a developing unit.

FIG. 3 shows an enlarged cross section of the developing unit 12. The developing unit 12 is described below referring FIG. 3. In FIG. 3, the developing unit 12 is arranged under the scanning unit 11, which includes a drum cartridge 20 freely releasably installed to the casing 2, and the photoreceptor drum 21 as an imager carrier, a developing cartridge 36, a scorotron charging device 25 and a transferring roller as the transferring means each provided in the drum cartridge 20. The developing cartridge 36 is releasably installed to the drum cartridge 20 and includes a developing roller 22 as the developer carrier, a thickness regulating blade 23, supplying roller 24 and a toner box 27.

In the toner box 27, a developer, for example a positively charged non-magnetic single component developer, is charged.

The toner is suitably employed in the image forming method (the image forming method according to the invention) including a process for fixing by passing the image forming support, on which images are formed, between a heating roller 32 and a pressing roller 31 constituting the fixing device. The fixed recording medium having the fixed toner is output to an outputting tray 35 through rollers 33 and 34.

Figure 6:
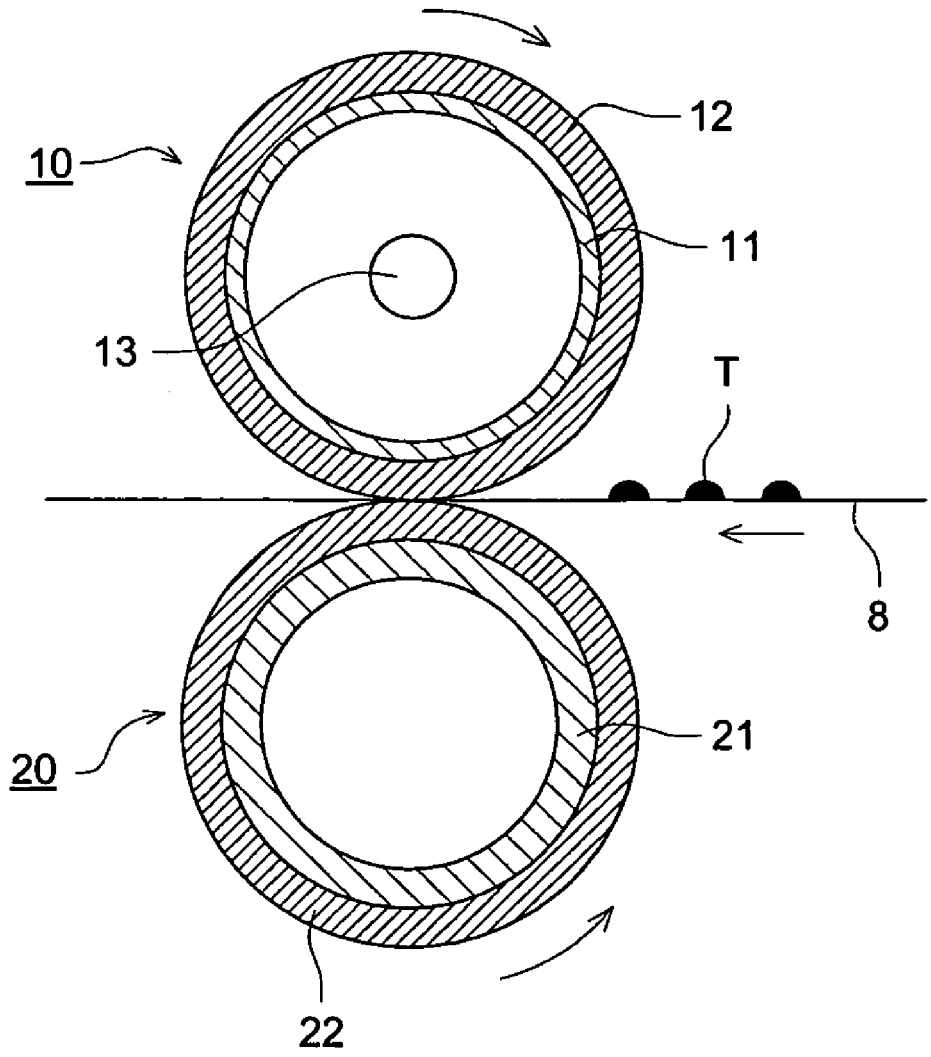
FIG. 6 shows a cross section of an example of fixing device employed in the invention.

FIG. 6 shows a cross section of an example of fixing device employed in the image forming method; the fixing device shown in FIG. 6 has a heating roller 10 and a pressing roller 20 contacted to the heating roller. In FIG. 6, T is a toner image formed on the transfer paper (the image forming support).

The heating roller is constituted by a core metal 11 and a covering layer composed of a fluororesin or elastic material formed on the core metal surface, and includes a line-shaped heater as a heating member 13.

The core metal 11 is composed of a metal and its interior diameter is from 10 mm to 70 mm. The metal of the metal core 11 is not specifically limited, for example, iron aluminum, copper and their alloys are employable.

The thickness of the metal core is from 0.1 mm to 15 mm, which is decided considering the balance of the requirement of energy saving (reducing the thickness) and the strength (depending on the constituting material). For example, a thickness 0.8 mm is necessary for aluminum core to obtaining the same strength as an iron core having a thickness of 0.57 mm.

As the fluororesin constituting the covering layer 12, PTEF (polytetrafluoroethylene) and PFA (tetrafluoroethylene-perfluoroalkylvinyl ether copolymer can be exemplified.

The thickness of the covering layer of the fluororesin is from 10 μm to 500 μm, and preferably from 20 μm to 400 μm.

When the thickness of the covering layer 12 composed of the fluororesin is less than 10 μm, the function of the covering layer cannot be satisfied and the durability of the fixing device cannot be secured. Besides, when the thickness exceeds 500 μm, the surface of the covering layer is easily damaged by paper powder, and a problem of image contamination caused by the damage is posed.

As the elastic material composing the covering layer 12, Silicone rubber having high heat resistivity such as LTV, RTV and HTV, and silicone sponge are preferable.

Ascar hardness of the elastic material composing the covering layer 12 is less than 80°, and preferably less than 60°.

The thickness of the covering layer 12 composed of the elastic material is from 0.1 mm to 30 mm, and preferably from 0.1 mm to 20 mm.

When the Ascar hardness of the elastic material composing the covering layer 12 exceeds 80°, or the thickness of the covering layer is less than 0.1 mm, the nip of fixing can not be made large so that the effect of soft fixing (for example, an improvement effect in the color reproducibility by the smoothed toner layer) cannot be displayed.

A halogen heater is suitably employed for the heating member 13.

The heating roller 20 is composed of a metal core 21 and a covering layer of an elastic material 22 formed on the surface of the metal core 21. The elastic material composing the covering layer 22 is not specifically limited, and various kinds of soft rubber such as urethane rubber and silicone rubber, and rubber sponge are employable, and the silicone rubber and silicone rubber sponge exemplified for the covering layer 12 are preferable.

Ascar hardness of the elastic material composing the covering layer 22 is less than 80°, and preferably less than 60°.

The thickness of the covering layer 22 is from 0.1 mm to 30 mm, and preferably from 0.1 mm to 20 mm.

When the Ascar hardness of the elastic material composing the covering layer 22 exceeds 80°, or the thickness of the covering layer is less than 0.1 mm, the nip of fixing can not be made large as that the effect of soft fixing cannot be displayed.

Though the material of the metal core 21 is not specifically limited, and a metal such as aluminum, iron and copper, and an alloy thereof can be cited.

The contacting load (the total load) applied between the heating roller 10 and the pressing roller 20 is usually from 40N to 350N, preferably from 50N to 300N, and more preferably from 50N to 250N. The contacting load is decided considering the strength (the thickness of the metal core 11), for example, it is preferably not more than 250N for a heating roller composed of iron with a thickness of 0.3 mm.

The nip width is preferably from 4 to 10 mm from the viewpoint of anti-offset property and the fixing ability, and the face pressure at the nipping portion is preferably from $0.6\times10^5$ Pa to $1.5\times10^5$ Pa. In an example of the fixing condition by the fixing device shown in FIG. 6, the fixing temperature (the surface temperature of the heating roller 10) is from 150° C. to 210° C. and the line speed of fixing is from 80 mm/sec to 640 mm/sec.

In the fixing device used in the invention, a cleaning mechanism may be provided according to necessity. In such the case, a cleaning method is applicable, in which silicon oil is supplied to the upper roller of the fixing device by a pad, roller or web each impregnated with silicone oil.

As the silicone oil, ones having a high heat resistivity such as polydimethylsilicon, polyphenylmethylsilicon and polydiphenylsilicon are employable. Ones having a viscosity of from 1 P·s to 100 P·s at 20° C. are suitably employed since the flowing amount on the occasion of using becomes too large when one having a low viscosity is employed. The effects of the invention are considerably enhanced when the image forming process includes the fixing step by a fixing device to which no or extremely small amount of silicone oil is supplied. Consequently, the supplying amount is preferably not more than 2 mg/4 A size sheet even when the silicone oil is supplied.

The adhering amount of the silicone oil to the transfer paper after fixing is reduced by making the supplying amount of the silicone oil to not more than 2 mg/4 A size sheet so that the difficulty of writing by a oily ink pen such as a ball point pen caused be adhering silicone oil to the transfer paper and the retouching ability is not degraded.

Moreover, problems such as lowering of the anti-offset ability in a long period caused by the deterioration of the silicone oil and the contamination of the optical system and the charging electrode by the silicone oil can be avoided.

The supplying amount of the silicone oil (Δw/100) is determined by that 100 sheet's of transfer paper (A4 size white paper) are continuously passed through the fixing device (between the rollers) heated at the designated temperature, and the difference the weight (Δw) of the fixing device before and that of the after passing of the transfer sheets is measured.

EXAMPLES

Though the invention is described below referring examples, the invention is limited to the examples.

Example 1

<<Preparation of External Additive A1>>

The external additive A1 containing irregular-shaped metal oxide was prepared by the followings.

Process 1: Preparation of Silica Particles Being the Medium

Silica particles to be employed for preparing the external additive A1 was prepared by the equipment shown in FIG. 4.

Chlormethoxysilane as a raw material was supplied to the burner provided on the top of the vertical burning furnace and sprayed into a fine droplet by air as a spraying medium from the nozzle provided at the end of the burner, and burned by a supporting flame by burning of propane. Oxygen and air is supplied from the burner as a burning sustaining gas.

The amounts of the raw material liquid, spraying air, the propane and the oxygen-air were each controlled at 6 kg to 8 kg, 6 $m^3$/h (normal), 0.4 $m^3$/h (normal) and 122 $m^3$/h (normal), respectively, and the flame temperature was controlled at 1,700° C. for burning. The product was recovered by a cyclone and a bag filter.

Water having a pH of 5.5 adjusted by acetic acid was sprayed to 100 parts by weight of the above obtained silica while vigorously stirred in a mixing vessel for performing the pre-treatment of the silica fine powder. To the silica fine particles, 25 parts by weight of hexamethylsilazane was further sprayed. After that, the powder was heated by 120° C. for performing the silylation treatment of the surface of the fine silica particles by hexamethylsilazane and the surface covering treatment by trimethylsilanol formed by hydrolysis of the heaxamethylsilazane and then the non-reacted hexamethylsilazane, excessive trimethylsilanol and moisture were removed so that the silylation treatment by hexamethylsilazane and the partial surface covering treatment trimethylsilanol are provided. Thus obtained silica fine powder was composed of spherical particles and the average value of the feret's diameter of the silica particles was 80 nm.

Process 2: Formation of External Additive A1

In 4 L of water, 100 g of the above silica particles were dispersed and the temperature of the liquid was raised by 70° C., and then 200 ml of a 100 g/L in terms of $TiO_2$ of titanium sulfate solution and a 5 moles/L of sodium hydroxide aqueous solution were simultaneously dropped so that the pH of the system becomes 6.0. After the dropping, the liquid was cooled by 40° C. and the pH was adjusted to 4.0, and then 40 g of the following cyclic silazane was added. After continuously stirring for 4 hours, the pH was adjusted to 6.5 by adding a 2 moles/L of sodium hydroxide solution, and the liquid was further stirred for 2 hours, and then the solid component was filtered and washed. The cake filtered and washed was dried at 130° C. and treated by an edge runner crusher for 1 hour at 247 N/cm, and further pulverized by a pulverized utilizing air jet system.

The almost part of the silica medium (the medium for forming the irregular shaped metal oxide) having low specific gravity (or density) was removed by suction into the bag filter 320 shown in FIG. 4 and the fine powder principally composed of the metal oxide is recovered by the cyclone 300.

By the above procedure, External Additive A1 was obtained, which was composed of a mixture of the silica used as the medium and the $TiO_2$ (titanium oxide) particles as the irregular shaped (tabular shaped particle in this case) metal oxide particle.

The average horizontal feret's diameter of the irregular shaped metal oxide of the obtained External Additive A1 was 725 nm.

<<Preparation of External Additive A2>>

External Additive A2 was prepared in the same manner as in External Additive A1 except that "the temperature of the liquid was raised by 70° C., and then 200 ml of a 100 g/L in terms of $TiO_2$ of titanium sulfate solution was dropped" was changed to that the temperature of the liquid was raised by 85° C., and then 400 ml of a 100 g/L in terms of $TiO_2$ of titanium sulfate solution was dropped.

<<Preparation of External Additive A3>>

External Additive A3 was prepared in the same manner as in External Additive A1 except that "the temperature of the liquid was raised by 70° C., and then 200 ml of a 100 g/L in terms of $TiO_2$ of titanium sulfate solution was dropped" was changed to that the temperature of the liquid was raised by 40° C., and then 100 ml of a 100 g/L in terms of $TiO_2$ of titanium sulfate solution was dropped.

<<Preparation of External Additive A4>>

External Additive A4 was prepared in the same manner as in External Additive A1 except that 50 ml of a 100 g/L in terms of $Al_2O_3$ of sodium aluminate solution was dropped in place of 200 ml of a 100 g/L in terms of $TiO_2$ of titanium sulfate solution.

<<Preparation of External Additive A5>>

External Additive A5 was prepared in the same manner as in External Additive A1 except that 50 ml of a 100 g/L in terms of $ZrO_2$ of zirconium oxochloride solution was dropped in place of the titanium sulfate solution.

<<Preparation of External Additive A6>>

External Additive A5 was prepared in the same manner as in External Additive A1 except that 50 ml of a 100 g/L in terms of $SnO_2$ of tin chloride solution was dropped in place of the titanium sulfate solution.

As results of observation of External Additives A1 through A6 by a transmission electron microscope (TEM), it was confirmed that the particle had the irregular shape and the crystalline area.

<<Preparation of External Additive A7: Spherical Titania (Comparative)>>

In 4 L of water, 50 g of spherical titanium oxide TAF-520, manufactured by Fuji Titan Co., Ltd., available on the market, was dispersed and the temperature and the pH of the liquid were each adjusted to 40° C. and 4.0, respectively, and then 40 g of cyclic silazane was added. After stirring for 4 hours, the pH was adjusted to 6.5 by adding a 2 moles/L sodium hydroxide solution, and further stirred for 2 hours, and then the titania was filtered and washed. The filtered and washed cake was dried at 130° C. and pulverized by the pulverizing machine utilizing air jet method to obtain External Additive A7.

<<Preparation of External Additive A8: Needle-Shaped Titania (Comparative)>>

External Additive A8 was prepared in the same manner as in External Additive A7 except that needle-shaped titania MT150, manufactured by Teika Co., Ltd., in place of the spherical titanium oxide TAF-520, manufactured by Fuji Titan Co., Ltd.

<<Preparation of External Additive A9: Irregular-Shaped Particle (Comparative)>>

External Additive A9 was prepared in the same manner as in External Additive A1 except that "the temperature of the liquid was raised by 70° C., and then 200 ml of a 100 g/L in terms of $TiO_2$ of titanium sulfate solution was dropped" was changed to that the temperature of the liquid was raised by 96° C., and then 800 ml of a 100 g/L in terms of $TiO_2$ of titanium sulfate solution was dropped.

<<Preparation of External Additive A10>>

External Additive A10 was prepared in the same manner as in External Additive A1 except that "the temperature of the liquid was raised by 70° C., and then 200 ml of a 100 g/L in terms of $TiO_2$ of titanium sulfate solution was dropped" was changed to that the temperature of the liquid was raised by 25° C., and then 100 ml of a 100 g/L in terms of $TiO_2$ of titanium sulfate solution was dropped.

The shape and the average value of the feret's diameter of each of thus obtained External Additives A1 through 10A are listed in the following Table 1.

TABLE 1

| External Additive A | Feret's diameter of External Additive A | Principal component of External Additive A | Shape of External Additive A |
|---|---|---|---|
| External Additive A1 | 725 | Titanium oxide | Irregular |
| External Additive A2 | 1326 | Titanium oxide | Irregular |
| External Additive A3 | 31 | Titanium oxide | Irregular |
| External Additive A4 | 921 | Aluminum oxide | Irregular |
| External Additive A5 | 1266 | Zirconium oxide | Irregular |
| External Additive A6 | 652 | Tin oxide | Irregular |
| Comparative External AdditiveA7 | 105 | Titanium oxide | Spherical |
| Comparative External AdditiveA8 | 40 | Titanium oxide | needle like |
| Comparative External AdditiveA9 | 1480 | Titanium oxide | Irregular |
| Comparative External AdditiveA10 | 18 | Titanium oxide | Irregular |

External Additives B1 through B6 each containing the hydrophobic particles were prepared as follows.

One hundred parts by weight of humid silica, Aerogel 130 manufactured by Nihon Aerogel Co., Ltd., was dried for 5 hours at 150° C. and cooled by a room temperature, and then 15 parts of cyclic silazane represented by the following formula was added in a nitrogen atmosphere and mixed for 20 minutes. After that, the stirring was continued for 15 hours at 85° C. in the nitrogen atmosphere to obtain External Additive B1.

<<Preparation of External Additive B2>>

External Additive B2 was prepared in the same manner as in External Additive B1 except that hexamethyldisilazane (HMDS) was added in place of cyclic silazane represented by Formula 1.

<<Preparation of External Additive B3>>

External Additive B3 was prepared in the same manner as in External Additive B1 except that Aerogel 50, manufactured by Nihon Aerogel Co., Ltd., was used in place of cyclic Aerogel 130, manufactured by Nihon Aerogel Co., Ltd.

<<Preparation of External Additive B4>>

External Additive B4 was prepared in the same manner as in External Additive B1 except that Aerogel 50, manufactured by Nihon Aerogel Co., Ltd., was used in place of cyclic Aerogel 130, manufactured by Nihon Aerogel Co., Ltd.

<<Preparation of External Additive B5>>

External Additive B5 was prepared in the same manner as in External Additive B1 except that Aerogel 300, manufactured by Nihon Aerogel Co., Ltd., was used in place of cyclic Aerogel 130, manufactured by Nihon Aerogel Co., Ltd.

<<Preparation of External Additive B6>>

External Additive B6 was prepared in the same manner as in External Additive B1 except that OX50, manufactured by Nihon Aerogel Co., Ltd., was used in place of cyclic Aerogel 130, manufactured by Nihon Aerogel Co., Ltd.

The composition and the average of feret's diameter of the particle contained in each of External Additives B1 through B6 containing hydrophobic particles are listed in the following Table 2.

TABLE 2

| External Additive B | Feret's diameter of External Additive B | Principal component of External Additive B | Hydrophobilizing agent in External Additive B |
|---|---|---|---|
| External Additive B1 | 16 | Amorphous silica | Cyclic silazane |
| External Additive B2 | 16 | Amorphous silica | HMDS |
| External Additive B3 | 30 | Amorphous silica | Cyclic silazane |
| External Additive B4 | 12 | Amorphous silica | Cyclic silazane |
| External Additive B5 | 80 | Amorphous silica | HMDS |
| External Additive B6 | 7 | Amorphous silica | HMDS |

Next, the following Toner Particle A (also refereed to as Toner A) was prepared.

<<Preparation of Toner Particle A>>

(Preparation of Latex 1HML)

(1) Preparation of Core Particles (the First Step Polymerization)

In a 5,000 ml separable flask attached with a stirring device, a thermal sensor, a cooling pipe and a nitrogen gas introducing device, a surfactant solution of 7.08 parts by weight of an anionic surfactant 101 dissolved in 3010 parts by weight of ion exchanged water (an aqueous medium) was charged and the temperature in the flask was raised by 80° C. while stirring at a stirring speed of 230 rpm under nitrogen gas stream.

To the surfactant solution, an initiator solution composed of 200 parts by weight of deionized water and 9.2 parts by weight of an initiator (potassium persulfate: KPS) dissolved in the deionized water was added and the temperature was adjusted to 75° C., and then a monomer mixture liquid composed of 70.1 parts by weight of styrene, 19.9 parts of n-butyl acrylate and 10.9 parts by weight of methacrylic acid was dropped spending for 1 hour, and then polymerization (the first step polymerization) was performed by heating and stirring the system at 75° C. for 2 hours to prepare a latex (a dispersion of resin particles of high molecular weight polymer). The latex was referred to as Latex 1H.

(2) Formation of Intermediate Layer (the Second Step Polymerization)

In a flask attached with a stirrer, a monomer solution was prepared by adding 98.0 parts by weight of the compound represented by Formula 19 (hereinafter referred to as Exemplified Compound 19) to a monomer mixture liquid composed of 105.6 parts by weight of styrene, 30.0 parts by weight of n-butyl acrylate, 6.2 parts by weight of methacrylic acid and 5.6 parts by weight of n-octyl-3-mercaptopropionic acid ester, and dissolving at 90° C.

On the other hand, A surfactant solution composed of 2,700 ml of ion exchanged water and 1.6 parts by weight of the anionic surfactant (Formula 101) dissolved therein were heated by 98° C., and 28 parts by weight in terms of solid component of Latex 1H, which was the dispersion of core particles, was added, and then the foregoing monomer solution of Exemplified Compound 19 was mixed and dispersed in the above mixture and dispersed for 8 hours by a mechanical dispersing machine having a circulation pass CLEARMIX, manufactured by M•Technique Co., Ltd., to form a dispersion (emulsion) containing emulsified particles (oil droplets).

To the dispersion (emulsion), an initiator solution composed of 240 ml deionized water and 5.1 parts by weight of the polymerization initiator (KPS) dissolved in the water and 750 ml of deionized water was added, and the system was heated and stirred at 98° C. for 12 hours-to perform polymerization (the second step polymerization). Thus latex (a dispersion of composite resin particles each constituted by the resin particle composed of the high molecular weight resin covered with an intermediate molecular weight resin) was obtained. The latex was referred to as Latex 1HM.

(3) Formation of Outer Layer (the Third Step Polymerization)

To the above-obtained Latex 1HM, an initiator solution composed of 200 ml of deionized water and 7.4 parts by weight of the polymerization initiator (KPS) dissolve in the deionized water was added and a monomer mixture liquid composed of 300 parts by weight of styrene, 95 parts by weight of n-butyl acrylate, 15.3 parts by weight of methacrylic acid and 10.4 parts by weight of n-octyl-3-mercaptopropionic acid ester was dropped spending for 2 hours at 80° C. After completion of the dropping, polymerization (the third step polymerization) was performed by heating and stirring for 2 hours. After that, the system was cooled by 28° C. to obtain latex (a dispersion of composite particles each having the core of the high molecular weight resin, an intermediate layer of the medium molecular weight resin containing Exemplified Compound 19 and the outer layer of a low molecular weight resin). The latex was referred to as Latex 1HML.

The composite resin particle constituting Latex 1HML has peaks of molecular weight at 138,000, 80,000 and 13,000, and the weight average particle diameter of the composite resin particles was 122 nm.

Into a solution prepared by dissolving 59.0 parts by weight of the anionic surfactant 101 in 1,600 ml of deionized water, 420 parts by weight of carbon black Regal 330, manufactured by Cabot Co., Ltd., was gradually added and dispersed by CLEARMIX, manufactured by M•Technique Co., Ltd., to prepare a dispersion of the colorant (hereinafter referred to as Colorant Dispersion 1). The weight average particle diameter of the colorant dispersion measured by an electrophoretic light scattering photometer ELS-800, manufactured by Ootsuka Denshi Co., Ltd., was 89 nm.

In a reaction vessel (a four mouth flask) to which a thermal sensor, a cooler, a nitrogen introducing device and a stirrer were attached, 420.7 parts by weight in terms of solid component, 900 parts by weight of deionized water and 166 parts by weight of Colorant Dispersion 1 were charged and stirred. After adjusting the temperature in the vessel to 30° C., a 5 moles/L sodium hydroxide solution was added to the above mixture to adjust the pH value to 10.0.

After that, a solution composed of 1,000 ml of deionized water and 12.1 parts by weight of magnesium chloride hexahydrate dissolved in the water was added to the above liquid spending 10 minutes while stirring at 30° C. After standing for 3 minutes, the temperature of the resultant liquid was raised by 90° C. spending for a time of from 6 to 60 minutes to form associated particles. In such the situation, the diameter of the associated particle was measured by Coulter Counter TA-II, and the growing of the particles was stopped by adding a solution composed of 1,000 ml of deionized water and, dissolved therein, 80.4 parts by weight of sodium chloride at the time when the number average particle diameter was attained at 4 μm, and the liquid was ripened by heating and stirring for 2 hours at 98° C. for continuing the fusion of the particles and the phase separation of the crystalline substance.

Thereafter, the liquid was cooled by 30° C. and the pH thereof was adjusted to 4.0 by adding hydrochloric acid, and stirring was stopped. Thus formed associated particles were separated from the liquid phase by a basket type centrifugal separating machine Mark III Type 60×40, manufactured by Matsumoto Kikai Co., Ltd., to form a cake of toner particles. The toner particles were was washed by water in the basket type centrifugal separating machine, and transferred to an air blowing drying machine and dried until the moisture content becomes 0.5% by weight. Thus Toner Particle A was obtained.

<<Preparation of Toner Particles 1 through 13 (External Additive Treatment)>>

To 100 parts by weight of Toner Particle A, 1.0 part by weight of External Additive A (A1 through A10) described in Table 1 and 0.6 parts by weight of External Additive B (one of B1 through B6) described in Table 2 were applied, and mixed for 60 minutes by a Henschel mixer (circumference speed: 42 m/sec, mixing temperature: 38° C.) to prepare Toner Particles 1 through 13.

TABLE 3

| Toner | External additive (A) | External additive (B) | Feret's diameter (A) | Feret's diameter (B) | External Additive A Principal component | External Additive A Shape | Principal component of External Additive B | Hydrophobilizing agent of External Additive B | Remarks |
|---|---|---|---|---|---|---|---|---|---|
| 1 | *1 A1 | *1 B1 | 725 | 16 | Titanium oxide | Irregular | Amorphous silica | Compound 1 | Inv. |
| 2 | *1 A1 | *1 B2 | 35 | 16 | Titanium oxide | Irregular | Amorphous silica | HMDS | Inv. |
| 3 | *1 A2 | *1 B3 | 1326 | 30 | Titanium oxide | Irregular | Amorphous silica | Compound 1 | Inv. |
| 4 | *1 A3 | *1 B4 | 20 | 12 | Titanium oxide | Irregular | Amorphous silica | Compound 1 | Inv. |
| 5 | *1 A4 | *1 B1 | 1370 | 16 | Aluminum oxide | Irregular | Amorphous silica | Compound 1 | Inv. |
| 6 | *1 A5 | *1 B1 | 1166 | 16 | Zirconium oxide | Irregular | Amorphous silica | Compound 1 | Inv. |
| 7 | *1 A6 | *1 B1 | 652 | 16 | Tin oxide | Irregular | Amorphous silica | Compound 1 | Inv. |
| 8 | — | *1 B1 | | 16 | — | None | Amorphous silica | HMDS | Comp. |
| 9 | *1 A1 | — | | none | Titanium oxide | Irregular | — | None | Comp. |
| 10 | *1 A7 | *1 B1 | 105 | 16 | Titanium oxide | Spherical | Amorphous silica | HMDS | Comp. |
| 11 | *1 A8 | *1 B1 | 40 | 16 | Titanium oxide | Needle like | Amorphous silica | HMDS | Comp. |
| 12 | *1 A9 | *1 B5 | 1480 | 80 | Titanium oxide | Irregular | Amorphous silica | HMDS | Comp. |
| 13 | *1 A10 | *1 B6 | 18 | 7 | Titanium oxide | Irregular | Amorphous silica | HMDS | Comp. |

Compound 1: Cyclic silazane compound
*1: External Additive
Inv.: Inventive
Comp.: Comparative In the non-magnetic single component image forming apparatus shown in FIGS. 2 and 3, the diameter of the developing roller was made 7 mm. The material of the developing roller was sand blasted aluminum. The motor for conveying the toner from the toner hopper to the developing device was continuously rotated and the toner was received in a weighing receptacle from the toner supplying opening and the conveying amount of the toner per minute was measured, and evaluated according to the following ranks. It was judged that the toner can be corresponded to an apparatus having a printing speed of 70 sheets per minute when the supplying amount is stably 2 g.

A: The average value of ten times of the measurement was from 2.00 to 2.05 g per minute, the measurement was performed once per day.

B: The average value of ten times of the measurement was from 2.02 to 2.12 g per minute, the measurement was performed once per day.

C: The average value of ten times of the measurement was from 2.00 to 2.22 g per minute, the measurement was performed once per day.

D: In several cases, the average value of ten times of the measurement was less than 2.00 g per minute; the measurement was performed once per day.

In this example, it was judged that the ranks C or higher were acceptable for practical use.

<<Raising Up of the Electrical Charge>>

The difference of the electrical charging mount on the developing roller q/m (1) after stirring for 1 minute from that q/m (20) after stirring for 20 minutes was determined by a suction type electrical charge measuring apparatus while supplying the toner in a rate of 2.22 g/minute assumed as the largest supplying amount, and evaluated according to the following ranking.

A: The average value of ten times of the measurement was within the range of from 2.00 to 2.05 g per minute; the measurement was performed once per day.

B: The average value of ten times of the measurement was within the range of from 2.02 to 2.12 g per minute; the measurement was performed once per day.

C: The average value of ten times of the measurement was within the range of from 2.00 to 2.22 g per minute; the measurement was performed once per day.

D: In several cases, the average value of ten times of the measurement was less than 2.00 g per minute; the measurement was performed once per day.

It was judged that the ranks C or higher were acceptable for practical use.

<<Toner Scattering>>

The number of scattered toner in air exhausted from the exhaust outlet of the image forming apparatus, from which the dust collection filter was removed, was measured by a particle counter MET ONE, manufactured by Pacific Scientific Instruments Co., Ltd., while printing 100 copies of a character image having a pixel ratio of 12%, and evaluation was performed according to the following ranking.

A: Accumulated number of powder dust containing leaked toner was less than 50.

B: Accumulated number of powder dust containing leaked toner was mot less than 50 and less than 100.

C: Accumulated number of powder dust containing leaked toner was not less than 100 and less than 500.

D: Accumulated number of powder dust containing leaked toner was not less than 500.

<<Burying of External Additive>>

The developing device was driven for 30 minutes without supplying toner, and then the toner particles were exemplified from the developing roller by double face adhesion tape, and the sample was observed by a field emission type transmission electron microscope (EF-TEM) for observing the burying state of the external additive on the toner surface, the variation was performed according to the following ranking.

A: Burying was not observed as to both of External Additives B and A.

B: The fixing state of only External Additive B was slightly varied but the number of the additive exposed on the surface is almost not changed.

C: The burry of External Additive B is progressed at a corner portion or a portion having high curvature and such the portions appeared slick.

D: The burying of External Additives A and B were progressed and almost surface of the toner particle appeared slick.

In this example, Rank C or higher were acceptable for the practical use.

<<Stability of the Developing Amount>>

Patch images for forming a developing amount of 0.6 mg/cm and that for forming a developing amount of 0.3 mg/cm were developed and the adhering amount of the toner on the photoreceptor was measured by peeling the toner by adhesion tape. The test was repeated for 20 times. The evaluation was preformed according to the following ranking.

A: The practical adhering amount was within the range of ±2.5% on both of the set adhering amount.

B: The practical adhering amount was within the range of ±3.0% on both of the set adhering amount.

C: The practical adhering amount was without the range of ±3.0% on both of the set adhering amount.

In this example, Rank B or higher were acceptable for the practical use.

<<Resolving Power>>

A resolving power test chart was printed and printed images were observed by a loupe having a magnifying ratio of 20 for evaluating the resolving power. The evaluation was performed according the following ranking.

A: Until lines of 14 lines/mm could be distinguished in both of the main scanning direction and the sub scanning direction.

B: Until lines of 10 lines/mm could be distinguished in both of the main scanning direction and the sub scanning direction.

C: Lines of 10 lines/mm could not be distinguished in both of the main scanning direction and the sub scanning direction.

<<Thermal Stability of the Toner>>

The apparatus of FIG. 2 was modified so that the copies can be output in a rate of 75 sheets per minute, and an image having a pixel ratio of 4% was copied for 12 hours in an environment of 30° C. and 90% RH. In the course of the printing, the temperature of the developing device was maximally attained at 50° C.

After that the apparatus was cooled by the room temperature and the toner in the developing device was recovered. The recovered toner was sieved through a sieve of 28 meshes to check the presence of a granule of the toner. The evaluation was performed according to the following ranking.

A: No toner granule was observed.

B: One to 5 toner granules were observed.

C: Six to 10 toner granules were observed.

D: The number of the toner granules was 11 or more, or the weight of the granules was not less than 1% by weight of the recovered toner.

In this example, Rank C or higher were acceptable for the practical use.

Results of the evaluations are listed in Table 4.

TABLE 4

| Developer | Toner number | Conveying ability of toner | Rising up of electrical charge | Toner scattering | Burying of external additives | Stability of developing amount | Resolving power | Thermal stability | Remarks |
|---|---|---|---|---|---|---|---|---|---|
| 1 | 1 | A | A | A | A | A | A | A | Inv. |
| 2 | 2 | A | A | A | A | A | A | A | Inv. |
| 3 | 3 | A | A | A | A | A | A | A | Inv. |
| 4 | 4 | A | A | A | A | A | A | A | Inv. |

TABLE 4-continued

| Developer | Toner number | Conveying ability of toner | Rising up of electrical charge | Toner scattering | Burying of external additives | Stability of developing amount | Resolving power | Thermal stability | Remarks |
|---|---|---|---|---|---|---|---|---|---|
| 5 | 5 | A | A | A | A | A | A | A | Inv. |
| 6 | 6 | A | A | A | A | A | A | A | Inv. |
| 7 | 7 | A | A | A | A | A | A | A | Inv. |
| 8 | 8 | C | D | D | D | C | C | D | Comp. |
| 9 | 9 | D | D | D | B | C | C | C | Comp. |
| 10 | 10 | C | C | C | C | C | C | D | Comp. |
| 11 | 11 | C | C | C | C | C | C | D | Comp. |
| 12 | 12 | C | C | C | C | C | C | C | Comp. |
| 13 | 13 | B | B | B | C | C | C | D | Comp. |

Inv.: Inventive
Comp.: Comparative

It is clear from Table 4 that the samples according to the invention are toners for developing electrostatic images which are better in the conveying ability of toner and the rising up of the electrical charge than those of the comparative samples, and the scattering of toner and burying of the external additive particles into the toner particle do not occur, the stability in the developing amount consumed by the image formation is high, and the resolving power of the formed images is high and the thermal stability of the toner itself is also high.

Example 2

Composite External Additives 1 through 6 were prepared as follows.

<<Preparation of Amorphous Silica Powders 1 trough 6 for Raw Material of Composite External Additive>>

Amorphous Silica Powders 1 through 8 for the raw material of the composite external additives were prepared as follows.

The vertical furnace shown in FIG. 4 was employed for preparing the silica for the raw material of the composite external additive.

Chlorotrimethoxysilan as the raw material liquid was supplied to the burner provided on top of the vertical furnace at an ordinary temperature and sprayed into a fine droplet from the spraying nozzle by air as the spraying medium and then burned using an assistant flame by burning propane. Oxygen and air were supplied from the burner as the burning supporting gas.

The supplying amount of the raw material liquid, the spraying air, the amount of propane and the supplying amount of oxygen and air were each controlled at 5 to 8 kg/HR, 1 to 7 $Nm^3$/hour, 0.4 $Nm^3$/hour and 15 to 184 $Nm^3$/hour, respectively, and the burning was performed at a flame temperature of 1,700° C., and the product was caught by the cyclone and the bag filter. Thus Amorphous Silica Powders m1 through m6 each having the average diameter of the primary particles listed in Table 1.

In the above, $Nm^3$/hour is employed as the unit of the supplying amount of the gas, which is a unit expressing the flowing amount of gas by normal notational system and is also described as $m^3$/h (normal), and expresses a flowing amount of gas at a temperature of 0° C. under a pressure of atmosphere of 1 atm (the standard condition).

As to the notational system of the unit of the flowing amount of gas, "Kitai keisoku you mensekiryuuryoukei ni okeru tan'i hyouki ni tuite (About notational system of the unit regarding an area flowing meter for measuring gas)" (on the home page of Tokyo Keiki Co., Ltd., http://www.toky-okeiso.co.jp/techinfo) is suitably referred.

TABLE 5

| Amorphous Silica Powder (before hydrophobilizing treatment) | Diameter of primary particle (nm) |
|---|---|
| m1 | 133 |
| m2 | 1297 |
| m3 | 24 |
| m4 | 80 |
| m5 | 1246 |
| m6 | 640 |

One hundred parts by weight of each of Amorphous Silica Powders m1 through m6 was pre-treated by spraying water adjusted at a pH of 5.5 by acetic acid while vigorously stirring in a mixing vessel. To the powder, 4 pars by weight of hexamethylsilazane was further sprayed.

The powder was heated by 120° C. so as to be subjected to silylization treatment by hexamethylsilazane and covering treatment by trimethylsilanol formed by hydrolysis of hexamethylsilazane. After that, non-reacted hexamethylsilazane, excessive trimethylsilanol and moisture were removed so as to provide the silylization treatment by hexamethylsilazane and partially surface covering treatment by trimethylsilanol. Thus Amorphous Silica Powders 1 through 6 were prepared.

(Preparation of Composite External Additive 1)

In 4 L of water, 100 g of Amorphous Silica Powder 1 was dispersed and then the temperature of the liquid was raised by 70° C. To the liquid, a titanium sulfate solution having a concentration of 100 g in terms of $TiO_2$ pre liter and a 5 moles/L of sodium hydroxide solution were simultaneously dropped so that the pH becomes 4.0. After completion of the dropping, the liquid temperature was lowered by 40° C. and the pH was adjusted to 6.5 by adding a 2 moles/L aqueous solution of sodium hydroxide. After standing for 2 hours while stirring, the particles were filtered and washed.

The resultant cake after the filtration and washing was dried at 130° C. and pulverized by the air-jet method. After that, 40 g of cyclic silazane represented by the following formula was added to the pulverized powder and held for 4 hours while stirring at 85° C., and cooled to obtain hydrophobilized Composite External Additive 1.

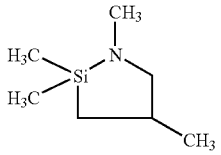

(Preparation of Composite External Additives 2 and 3)

Composite External Additives 2 and 3 were each prepared in the same manner as in Composite External Additive 1 except that Amorphous Silica Powders 2 and 3 were employed, respectively, in place of Amorphous Silica Powder 1.

(Preparation of Composite External Additive 4)

Composite External Additive 4 was prepared in the same manner as in Composite External Additive 1 except that Amorphous Silica Powder 3 was employed in palace of Amorphous Silica Powder 1 and the titanium sulfate solution was replaced by 100 ml of a sodium aluminate solution having a concentration of 100 g/L in terms of $Al_2O_3$.

(Preparation of Composite External Additive 5)

Composite External Additive 4 was prepared in the same manner as in Composite External Additive 1 except that Amorphous Silica Powder 5 was employed in palace of Amorphous Silica Powder 1 and the titanium sulfate solution was replaced by 100 ml of a zirconium oxochloride solution having a concentration of 100 g/L in terms of $ZrO_2$.

(Preparation of Composite External Additive 6)

Composite External Additive 6 was prepared in the same manner as in Composite External Additive 1 except that Amorphous Silica Powder 6 was employed in palace of Amorphous Silica Powder 1 and the titanium sulfate solution was replaced by 30 ml of a stannic chloride solution having a concentration of 100 g/L in terms of $SnO_2$.

It was confirmed that there was a crystalline structure area in the metal oxide area (referred also to as the metal oxide phase) on the surface of each of Composite External Additives 1 through 6 by observation using the transmission electron microscope.

It was also confirmed that the primary particle diameter of Amorphous Silica Powders 1 through 6 before the hydrophobilizing treatment were each the same as that Amorphous Silica Powders 1 through 6 after the treatment, respectively.

Properties of thus obtained composite external additives are shown in Table 6.

TABLE 6

| Composite External Additive | Diameter of primary particle (nm) | Mother particle (or core particle) | Composition of metal oxide area | True density ($g/cm^3$) |
|---|---|---|---|---|
| 1 | 140 | Amorphous silica | Titanium oxide | 3.25 |
| 2 | 1326 | Amorphous silica | Titanium oxide | 2.84 |
| 3 | 31 | Amorphous silica | Titanium oxide | 3.68 |
| 4 | 85 | Amorphous silica | Aluminum oxide | 3.11 |
| 5 | 1266 | Amorphous silica | Zirconium oxide | 4.21 |
| 6 | 652 | Amorphous silica | Stannic oxide | 4.76 |

<<Preparation of External Additive to be Used Together>>

External Additives 1 through 4 to be used together with the foregoing Composite External Additives 1 through 6 were prepared as follows.

One hundred parts by weight of humid silica, Aerogel 130 manufactured by Nihon Aerogel Co., Ltd., was dried for 5 hours at 150° C. and the cooled by an ordinary temperature, and then 15 parts by weight of the foregoing cyclic silazane was added in nitrogen atmosphere and stirred for 20 minutes. After that, the stirring was continues for 15 hours at 85° C. in the nitrogen atmosphere to prepare External Additive 1 to be used together.

<<Preparation of External Additive 2>>

External Additive 2 was prepared in the same manner as in External Additive 1 except that HMDS (hexamethylsilazane) was added in place of the cyclic silazane.

<<Preparation of External Additive 3>>

External Additive 3 was prepared in the same manner as in External Additive 1 except that Aerogel 200 (manufactured by Nihon Aerogel Co., Ltd., was added in place of Aerogel 130 (manufactured by Nihon Aerogel Co., Ltd.

<<Preparation of External Additive 4>>

External Additive 4 was prepared in the same manner as in External Additive 1 except that Aerogel 300 (manufactured by Nihon Aerogel Co., Ltd., was added in place of Aerogel 130 (manufactured by Nihon Aerogel Co., Ltd.

Properties of External Additives 1 through 4 are listed in Table 8.

TABLE 8

| External Additive | Diameter of primary particle (nm) | Principal component (Not less than 50% by weight) | Hydrophobilizing agent |
|---|---|---|---|
| 1 | 16 | Amorphous silica | Cyclic silazane |
| 2 | 16 | Amorphous silica | HMDS |
| 3 | 12 | Amorphous silica | HMDS |
| 4 | 7 | Amorphous silica | HMDS |

HMDS: Hexamethylsilazane

<<Preparation of Toner a>>: Preparation of Toner Before Addition of External Additive Toner particle the same as the foregoing Toner Particle A was employed.

<<Preparation of Toners 1 through 6>>: Preparation by Mixing Toner Particle A and the External Additives To 100 parts by weight of Toner a, 1.0 parts by weight of the composite external additive and 0.6 parts by weight the external additive to be used together with the composite external additive were added in the combination described in Table 4 and mixed by Henschel mixer, and then coarse particles were removed by a sieve having openings of 45 μm to prepare Toners 1 through 6.

TABLE 9

| Developer No. | External additive | Coexisting external additives |
|---|---|---|
| 1 | Composite External Additive 1 | External Additive 1 |
| 2 | Composite External Additive 2 | External Additive 2 |

TABLE 9-continued

| Developer No. | External additive | Coexisting external additives |
|---|---|---|
| 3 | Composite External Additive 3 | None |
| 4 | Composite External Additive 4 | External Additive 2 |
| 5 | Composite External Additive 5 | External Additive 3 |
| 6 | Composite External Additive 6 | External Additive 4 |

<<Preparations Developer 1 through 6>>

Developers 1 through 6 were prepared by mixing a silicone resin coated ferrite carrier having a volume average particle diameter of 60 μm to each of the Toners 1 through 6 so that the toner concentration become to 6% by weight.

<<Evaluation of Developer>>

An electrophotographic color printer C-1616 available on the market, manufacture by Fuji Xerox Co., Ltd., was modified to install a photoreceptor having a diameter of 20 mm and was employed for evaluation of the developer.

For clearly evaluating the properties of the developer, the same toner and the developer were entirely charged into the four developing device for four colors.

<<Stability of Developing Amount>>

<<Stability of the Developing Amount>

Patch images to cause a developing amount of 0.6 mg/cm and that to cause a developing amount of 0.3 mg/cm were developed and the adhering amount of the toner on the photoreceptor was measured by peeling the toner by an adhesion tape. The test was repeated for 20 times. The evaluation was preformed according to the following ranking.

A: The practical adhering amount was within the range of ±2.5% on both of the set adhering amount.

B: The practical adhering amount was within the range of ±3.0% on both of the set adhering amount.

C: The practical adhering amount was without the range of ±3.0% on both of the-set adhering amount.

<<Rising of Electrical Charge at Low Temperature and Humidity>>

Printing of 50,000 sheets was carried out under a low temperature and humidity condition (10° C., 20% RH), and the electro charging amount and the image density were measured at the initial time and after the printing of 50,000 sheets. The developer in the four developing device was sampled and the electrical charging amount of them was measured by a blow-off charging amount measuring apparatus TB-200 (Toshiba Chemical Co., Ltd.), and evaluated according to the following ranking.

A: The rising of the electrical charge and the lowering of the image density between the start and the completion of the 50,000 sheets printing were each less than 3.0 μC/g and less than 0.01, respectively. (Excellent)

B: The rising of the electrical charge and the lowering of the image density between the start and the completion of the 50,000 sheets printing were each from 3.0 to 6.0 μC/g and less than 0.04, respectively. (Good)

C: The rising of the electrical charge and the lowering of the image density between the start and the completion of the 50,000 sheets printing were each not less than 6.0 μC/g and not less than 0.04, respectively. (Poor)

<<Release of External Additive>>

The surface of the carrier was observed after printing of 100,000 sheets by an electric field scanning electron microscope available on the market by a magnitude of 40,000 times, and the adhering status of the external additive on the carrier surface was ranked as follows for evaluation.

A: Almost not external additive released from the toner adhered.

B: Two to 10 particles of the external additive released from the toner were on the area of 1 μm square, but charge hindrance did not occur.

C: Thirty or more particles of the external additive released from the toner were on the area of 1 μm square, and the electrical charging amount was lowered not less than 10 μC/g compared with that at the initial time and scattering of the toner and fogging occurred.

<<Resolving Power>>

A resolving power test chart was printed and printed images were observed by a loupe having a magnifying ratio of 20 for evaluating the resolving power. The evaluation was performed according the following ranking.

A: Until lines of 14 lines/mm could be distinguished in both of the main scanning direction and the sub scanning direction.

B: Until lines of 10 lines/mm could be distinguished in both of the main scanning direction and the sub scanning direction.

C: Lines of 10 lines/mm could not be distinguished in both of the main scanning direction and the sub scanning direction.

<<Lifetime of Developer>>

A cartridge for 30,000 prints, according to the maker, was employed and the developer used in the cartridge was transferred to next new cartridge every 30,000 prints so as to continue the test of the durability of the developer, and the quality of the formed image is visually observed according to the following ranking.

A: The quality of the printed image is not varied until the total number of prints of 600,000; the lifetime is extremely long: Good.

B: The quality of the printed image is slightly degraded between the total printing numbers from 300,000 to 600,000; the lifetime is long: Good.

C: The quality of the printed image is slightly degraded between the total printing numbers from 60,000 to 290,000; the lifetime is short a little.

D: The quality of the printed image is slightly degraded between the total printing numbers from 30,000 to 50,000; the lifetime is short: Problem is posed.

Results are listed in Table 10.

TABLE 10

| Developer No. | Stability of developing amount | Rising of charging amount a low temperature and humidity | Releasing of external additive | Resolving power | Lifetime of developer | Remarks |
|---|---|---|---|---|---|---|
| 1 | A | A | A | A | A | Inv. |
| 2 | A | A | B | A | B | Inv. |

TABLE 10-continued

| Developer No. | Stability of developing amount | Rising of charging amount a low temperature and humidity | Releasing of external additive | Resolving power | Lifetime of developer | Remarks |
|---|---|---|---|---|---|---|
| 3 | B | A | A | B | A | Inv. |
| 4 | A | A | A | A | A | Inv. |
| 5 | A | B | B | A | B | Inv. |
| 6 | A | B | A | A | A | Inv. |

Inv.: Inventive

It is cleared from Table 10 that are small in the rising of the charging amount is small, the releasing of the external additive is not caused by Developers 1 through 6, and the lifetime of them is long.

What is claimed is:

1. A toner for developing electrostatic images comprising:

an external additive particle having a diameter of primary particle of from 25 nm to 1450 nm and a true density of from 2.5 g/cm$^3$ to 4.8 g/cm$^3$, the external additive particle has a core portion of silica, titania or alumina and the surface of the external additive contains an amorphous silica area and a metal oxide area;, wherein the toner contains a toner particle and the toner particle is produced by a process for fixing a resin particle on a mother particle and a glass transition point of the resin particle (Tgs) is higher than a glass transition point of the mother particle (Tgm).

2. The toner of claim 1, wherein the metal oxide area has a crystalline structure area.

3. The toner of claim 1, wherein the metal oxide is at least one of silica, titanium oxide and aluminum oxide.

4. The toner of claim 1, having a number based median diameter (d50) of from 3 to 10 μm.

5. The toner of claim 1, wherein an average value of the circular degree calculated by the following expression of 2,000 toner particles is from 0.94 to 0.99;

Circular degree=(Circumference length of corresponding circle)/(Circumference length of the projection image of toner particle).

6. The toner of claim 1, wherein the core particle is made of amorphous silica.

7. The toner of claim 6, wherein the diameter of primary particle of the external additive is from 35 nm to 500 nm.

8. The toner of claim 6, wherein the diameter of primary particle of the external additive is from 40 to 300 nm.

9. The toner of claim 1, comprising toner particles having a shape coefficient within the range of from 1.0 to 1.6, account for not less than 65% in number.

10. The toner of claim 1, comprising toner particles having a variation coefficient of the shape coefficient of not more than 16%.

11. The toner of claim 1, comprising toner particles having a number variation coefficient of not more than 27%.

12. The toner of claim 1, comprising toner particles without corner 50% or more in number.

13. The toner of claim 1, wherein ratio of 50%-volume particle diameter Dv50 to 50%-number particle diameter distribution Dp50 (Dv50/Dp50) is from 1.0 to 1.15.

14. The toner of claim 1, comprising not more than 10% in number of toner particles having diameter not more than 0.7×Dv75 of the accumulative 75%-volume particle diameter from the large size.

* * * * *